US006349833B1

(12) United States Patent
Oyama et al.

(10) Patent No.: US 6,349,833 B1
(45) Date of Patent: Feb. 26, 2002

(54) METHOD OF FEEDING SINTERING MATERIAL BY USE OF MAGNETIC FORCES

(75) Inventors: Nobuyuki Oyama; Kouichi Nushiro; Katsutoshi Igawa, all of Okayama; Seiji Taguchi, Tokyo; Norifumi Fujii, Okayama; Kenji Takihira, Okayama; Rikio Ono, Okayama; Takahiro Kumeda, Okayama, all of (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/091,898

(22) PCT Filed: Dec. 18, 1996

(86) PCT No.: PCT/JP96/03694

§ 371 Date: Jun. 22, 1998

§ 102(e) Date: Jun. 22, 1998

(87) PCT Pub. No.: WO97/23657

PCT Pub. Date: Jul. 3, 1997

(30) Foreign Application Priority Data

Dec. 22, 1995 (JP) ..... 7-334477
Mar. 15, 1996 (JP) ..... 8-058645

(51) Int. Cl.[7] ..... B03C 1/00; C22B 1/20

(52) U.S. Cl. ..... 209/214; 209/219; 75/749; 75/758

(58) Field of Search ..... 209/213, 214, 209/217, 219; 75/746, 749, 755, 758, 759

(56) References Cited

U.S. PATENT DOCUMENTS 675,162 A * 5/1901 Noble ..... 209/219
1,617,971 A * 2/1927 Ullrich ..... 209/219 X
5,785,737 A * 7/1998 Lynn et al. ..... 75/746 X

FOREIGN PATENT DOCUMENTS

DE 974139 * 7/1949 ..... 209/219

* cited by examiner

*Primary Examiner*—Tuan N. Nguyen
(74) *Attorney, Agent, or Firm*—Orum & Roth

(57) ABSTRACT

In a method of the magnetic loading of a sintering material, magnetically susceptible sinterable substances of high magnetization and fine substances of slidable dropping at low speed are segregated in great amounts in an upper portion of a sintering material layer deposited on a pallet. More of magnetically susceptible sinterable substances such as mill scale, returned ore and the like of good magnetic attachment and fine substances of low drop speed are caused to be segregated in the upper portion of that layer. A magnetic force is applied to a starting sintering material, during movement of the latter having been facilitated in its particle size segregation on a sloping chute, by use of a cylindrical magnetic drum having built therein a permanent magnet and disposed downwardly of the sloping chute.

16 Claims, 16 Drawing Sheets

METHOD OF FEEDING SINTERING MATERIAL BY USE OF MAGNETIC FORCES

BACKGROUND OF THE INVENTION

1. Field of the Invention

The present invention is directed to a method of magnetically loading a sintering material into a Dwight-Lloyd sintering apparatus in which a sintered ore is produced as one of the sintered materials for use in a blast furnace. The invention has particular reference to a method wherein magnetically susceptible sinterable substances such as ferrous metal-rich mill scale, calcium ferrite-containing returned ore and the like, and fine or particulate sinterable substances are charged on a pallet mounted on the sintering apparatus in such a manner that the two different types of substances are segregated in large amounts in an upper portion of a sintering material layer deposited on the pallet.

2. Description of the Related Art

In the production of a sintered ore using a sintering apparatus of a Dwight-Lloyd type (referred to hereinbelow as a DL sintering apparatus), ferrous metal-containing iron sources such as particulate iron ore, iron sand, mill scale and the like are first intermixed with secondary materials such as limestone, serpentine, returned ore and the like and further with fuel sources such as coke dust, gas ash and the like, whereby a sintering material is prepared which is then adjusted in its water content to about 7% and placed in granulated form. As shown in FIG. 28 of the accompanying drawings, a sintering material 2 that has been put in an ore supplying hopper 1 mounted on a DL sintering apparatus is cut by means of a drum feeder 3 and supplied to a sloping chute 4 of a plate type. The sintering material 2 is segregated in regard to its particle sizes upon percolation (filtration or penetration) when it is slidably dropped out of the sloping chute 4, and hence, such sintering material becomes rich in fine sinterable substances in its lower layer portion and rich in coarse sinterable substances in its upper and intermediate layer portions.

The sintering material 2 thus segregated upside down is subjected to inverse segregation of the particle sizes when it is charged from a lower end of the sloping chute 4 to a pallet 5 disposed to continuously travel in an arrowed direction. Thus, a sintering material layer 7 of a given thickness is formed with relatively fine sinterable substances segregated in its upper portion and relatively coarse sinterable substances segregated in its intermediate and lower portions. The sintering material layer 7 is subsequently ignited on its surface portion with a pilot burner (not shown) and sintered, while the pallet 5 is caused to move toward a rear end of the sintering apparatus, with air above the layer 7 being suctioned downwardly of a grate bar located on the pallet, the suctioning being conducted by the use of an exhauster (not shown). In this way, a sintered ore is produced.

In the sintering operation, the particle size distribution and compositional distribution of a sintering material deposited to correspond to the height of a sintering material layer bring about an important effect on successful sintering. Namely, at an initial stage of ignition in an igniting furnace, air is allowed to pass through the sintering material layer 7 from its ignited surface to its bottom upon suction at a lower part of the pallet 5. In this course of sintering, air of normal temperature is supplied without preheating to a sintered melt zone (for example, a region of higher than 1,200° C.) that has been defined in an upper portion of the sintering material layer 7. At middle and last stages of sintering, however, air to be suctioned downwardly of the layer 7 is passed through a completely sintered region in that upper portion and hence preheated, followed by feeding to sintered melt zones defined in the intermediate and lower portions of the layer 7.

Consequently, the upper portion of the sintering material layer is lower in the bulk temperature and besides shorter in the length of time for exposure to elevated temperature than the intermediate and lower portions. This leaves the problem that a sintered ore formed in the upper portion is low in melt bonding and hence small in mechanical strength with reduced sintering yield.

In recent years, as a certain method of the loading of a sintering material, segregation loading has been highly reputed in which the particle size distribution and carbon content of a sintering material layer deposited on a pallet can be varied at will. Such method has been found effective in alleviating the problems discussed above.

Japanese Unexamined Patent Publication No. 61-223136 discloses, for instance, that a sintering material layer to be formed on a pallet should be reduced in its density by means of a screen constituted with a plurality of wire materials extending along a flow of sintering material being loaded on the pallet, and at the same time, the sintering material should be segregated with fine particles held in an upper layer and with coarse particles held in intermediate and lower layers so as to make the upper layer highly permeable to air with eventual improvement of yield and productivity of a sintered ore. This prior art method, however, has the problem that since a sintering material of 7% or so in water content is prone to get adhered to the wire materials, the resultant sintering material layer is difficult to stably retain in a segregated state as originally desired.

Japanese Unexamined Patent Publication No. 63-263386 discloses that a sintering material layer to be formed on a pallet should be reduced in density with fine particles segregated in an upper layer portion and with coarse particles segregated in a lower layer portion by use of a plurality of wires disposed perpendicular to a flow of sintering material being loaded on the pallet and by proper adjustment of the wire-to-wire openings to thereby improve the yield and productivity of a sintered ore owing to increased air permeability in the upper layer.

Such known method is contrived to remove part of the sintering material having been adherent to the wires by causing the latter to be displaced with use of a wind-up drum. However, since the wire openings once clogged with the sintering material are extremely difficult to free from the latter, the resulting sintering material layer cannot be stably retained in an initially expected segregated state.

On the other hand, in Japanese Unexamined Patent Publication No. 5-311257, a method is disclosed wherein a mixture of a combustible gas and a low-melting material is sprayed onto an upper portion of a sintering material layer deposited on a pallet with use of a sintering material in common use. In this instance, the heat of the combustible gas and the low-melting material are successively supplied to the upper portion of that layer. This means that sintering reaction improves in the upper layer portion, leading to a sintered ore of high strength. Such method, however, has rather a different but serious problem in that supply of a combustible gas, mixing of a low-melting material therewith, and transportation of and spraying of both gas and material require added equipment, thus entailing increased cost for installation or remolding of the new or existing equipment.

Furthermore, Japanese Unexamined Patent Publication No. 58-133333 discloses loading a sintering material on a pallet by applying a magnetic force, through an electromagnet disposed on a loading device, to a sintering material on dropping. More specifically, the electromagnet is secured to a roll feeder or the like located downwardly of an ore supplying hopper, and the magnetic force is given via the electromagnet to the content of ferrous metal (Fe) present in the sintering material being loaded. The drop speed of Fe is hence reduced with gentle loading of the sintering material ensured. Fine particles are relatively susceptible to higher magnetization than are coarse particles, and therefore, the lower the drop speed is, the particles become finer. This denotes that the coarse particles drop on the pallet earlier and enter a lower portion of a sintering material layer, whereas the fine particles enter an upper portion of that layer. The sintering material is thus placed in segregated condition.

However, in a system having an electromagnet fixed to a rotary feeder, a sintering material segregated in its particle sizes on such rotary feeder is turned upside down when it is charged from the latter feeder to a sloping chute. This would often invite some adversely affected results. It is thought here that the magnetically attracted Fe content might possibly be separated by repeating an on-off manipulation of the electromagnet. In such instance, magnetic field generation and Fe separation are unfeasible in continuous fashion so that stable segregation is not attainable with poor efficiency.

SUMMARY OF THE INVENTION

In order to solve the foregoing problems of the prior art, the present invention has for its object to provide a method of the magnetic loading of a sintering material which can be practiced substantially without added equipment for avoiding marred adherence of a sintering material as well as added equipment for incorporating secondary materials that results in increased investment and which can also be implemented, with minimized formation of a sintered ore of undesirable brittleness in an upper portion of a sintering material layer as experienced with conventional practice, by applying a magnetic force to the sintering material immediately before loading on a pallet so as to desirably or intentionally vary the material composition and particle size distribution in a direction corresponding to the height of the sintering material layer. This unique construction contributes greatly to enhanced yield and productivity of a sintered ore.

In achieving the aforementioned object, the present invention in a first aspect provides a method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the starting sintering material into layered form on the pallet, the method comprising: applying a magnetic force to the starting sintering material having been cut through the drum feeder and being continuously flowed as the starting sintering material is slidably dropped out of a tip of a sloping chute of a plate type onto the pallet, the magnetic force being generated by a cylindrical magnetic drum located downwardly of the sloping chute; and causing magnetically susceptible sinterable substances present in the starting sintering material to be magnetically attracted toward and attached to a lower portion of the sintering material layer, while segregating fine substances of low drop speed present in the starting sintering material in that lower portion, whereby both the magnetically susceptible sinterable substances and the fine substances of low drop speed are segregated in large amounts in an upper portion of the sintering material layer on the pallet by inverting the starting sintering material upside down when it is loaded on the pallet with use of the magnetic drum.

In a second aspect, the invention provides a method of the magnetic loading of a sintering material as defined in the first aspect, wherein part of the starting sintering material having become adherent to the magnetic drum is removed by a scraper disposed in abutting relation to the magnetic drum and is then recovered on the pallet.

In a third aspect, the invention provides a method of the magnetic loading of a sintering material as defined in the first aspect, wherein an endless belt is arranged in interengagement with the magnetic drum located downwardly of the plate-type sloping chute and also with a drum placed opposite to the magnetic drum, and part of the starting sintering material having been adherent to the endless belt is removed by a scraper held in abutting relation to the endless belt and is then recovered on the pallet.

In a fourth aspect, the invention provides a method of the magnetic loading of a sintering material as defined in any one of the first to third aspects, wherein an ancillary sloping chute is located beneath the plate-type sloping chute normally disposed in parallel spaced relation to the latter, the normal sloping chute being reciprocative between a position in which it is operative and an upwardly slant position in which it is retractive, the magnetic drum located downwardly of the normal sloping chute is horizontally reciprocative forward and backward, and the starting sintering material is adjusted such that the path of dropping from the ancillary sloping chute to the magnetic drum is prevented from becoming varied through horizontal reciprocation of the magnetic drum located downwardly of and correspondingly to the ancillary sloping chute when the starting sintering material is charged by the downward ancillary sloping chute during displacement of the normal sloping chute from its operative position to its upward retractive position so as to remove part of the starting sintering material having adhered thereto.

In a fifth aspect, the invention provides a method of the magnetic loading of a sintering material as defined in any one of the first to fourth aspects, wherein a permanent magnet is disposed downwardly of the plate-type sloping chute, and the speed at which the starting sintering material is dropped from the sloping chute to the magnetic drum is reduced by magnetization of, through the magnetic force of the permanent magnet, the starting sintering material while it is being dropped out of the sloping chute.

In a sixth aspect, the invention provides a method of the magnetic loading of a sintering material as defined in any one of the first to fifth aspects, wherein an auxiliary magnetic drum is arranged upstream of and oppositely to the magnetic drum located downwardly of the plate-type sloping chute, and magnetically susceptible sinterable substances present in the starting sintering material are magnetically attached to the auxiliary magnetic drum through its magnetic action, which sinterable substances have failed to get magnetically attracted to the magnetic drum during dropping between the magnetic drum and the auxiliary magnetic drum.

In a seventh aspect, the invention provides a method of the magnetic loading of a sintering material as defined in any one of the first to sixth aspects, wherein a first magnetic drum located downwardly of an upper sloping chute of a plate type and a second magnetic drum located downwardly of a lower magnetic drum of a plate type are serially arranged in a two-staged formation, and magnetically susceptible sinterable substances present in the starting sintering material having dropped out of the upper sloping chute are magnetically attached to the first magnetic drum by its magnetizing action, while magnetically susceptible sinterable substances having dropped out of the lower sloping chute are magnetically attached to the second magnetic drum through its magnetizing action.

In an eighth aspect, the invention provides a method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the upper portion of that layer deposited on the pallet, the method comprising: dropping the starting sintering material cut by the drum feeder out of a sloping chute of a belt conveyor type in which a magnetic drum is placed on a driving side and a separate drum on a driven side; causing magnetically susceptible sinterable substances present in starting sintering material to be magnetically attached to the magnetic drum through its magnetizing action; and then segregating the resultant sinterable substances, together with fine substances of low drop speed in the sintering material, in a lower portion of the sintering material layer while the magnetic drum is being rotated forward or backward, whereby the starting sintering material is loaded directly on the pallet from the belt conveyor-type sloping chute.

In a ninth aspect, the invention provides a method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the starting sintering material into layered form on the pallet, the method comprising: applying a magnetic force to the starting sintering material cut by the drum feeder, the magnetic force being generated from a magnetic drum positioned to rotate in a direction along which the starting sintering material is dropped; causing magnetically susceptible sinterable substances present in the starting sintering material to be magnetically attached to the magnetic drum; and then segregating the resultant sinterable substances together with fine substances present in the starting sintering material, whereby the starting sintering materials is loaded directly on the pallet from the magnetic drum.

In a tenth aspect, the invention provides a method of the magnetic loading of a sintering material as defined in any one of the first to ninth aspects, wherein the magnitude of magnetic force of the magnetic drum, or the number of revolution of the latter is adjusted depending on the target amount of the magnetically susceptible sinterable substances to be segregated in an upper portion of the sintering material layer loaded on the pallet.

In an eleventh aspect, the invention provides a method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the starting sintering material into layered form on the pallet, the method comprising: dropping the starting sintering material cut by the drum feeder out of a sloping chute of a plate type having a plurality of permanent magnets arrayed in a backwardly serially vertical posture; and causing magnetically susceptible sinterable substances present in the starting sintering material to be magnetically attached to the sloping chute; and then segregating the resultant sinterable substances, together with fine substances present in the starting sintering material, in a lower portion of the sintering material layer, whereby the starting sintering material is loaded directly on the pallet from the sloping chute.

In a twelfth aspect, the invention provides a method of the magnetic loading of a sintering material as defined in the eleventh aspect, wherein the magnitude of magnetic force of each of the permanent magnets is adjusted depending on the target amount of said magnetically susceptible sinterable substances to be segregated in an upper portion of the sintering material layer loaded on the pallet.

In a thirteenth aspect, the invention provides a method of the magnetic loading of a sintering material as defined in the eleventh aspect, wherein as the starting sintering material is dropped out of the plate-type sloping chute disposed such that the permanent magnets arrayed in a backwardly serially vertical posture are increased in their magnitudes of magnetic forces gradually from top to bottom, the magnetically susceptible sinterable substances are magnetically attached by the permanent magnets through their magnetic forces, whereby the starting sintering material is loaded directly on the pallet from the sloping chute.

In a fourteenth aspect, the invention provides a method of the magnetic loading of a sintering material as defined in the thirteenth aspect, wherein the strength of magnetic force of each of the permanent magnets is adjusted depending on the bulk density of the starting sintering material to be loaded on the pallet.

DESCRIPTION OF THE PREFERRED EMBODIMENTS

Figure 1:
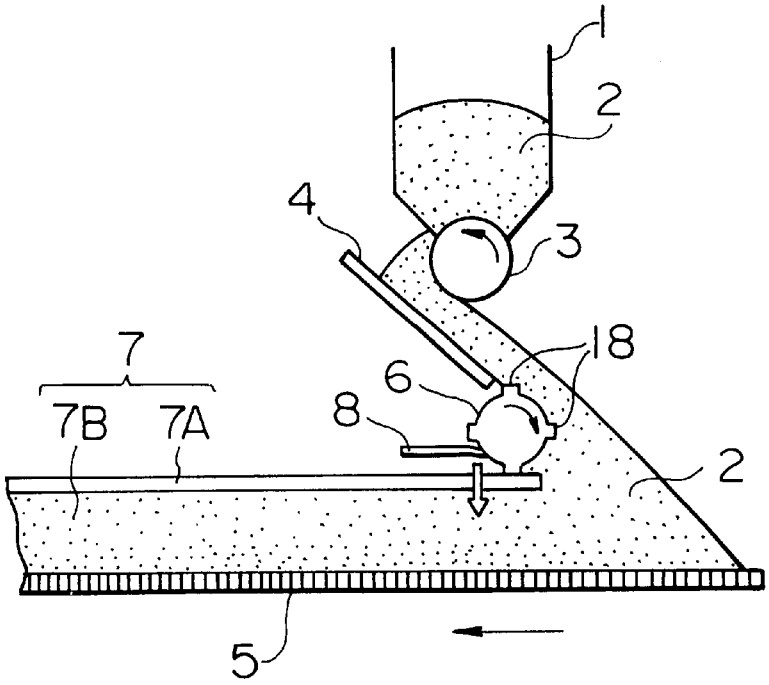
FIG. 1 is a vertically cross-sectional view showing the sintering material loading apparatus for use in the present invention.

In the present invention, a sintering material is subjected to particle size segregation with coarse sinterable substances of a large particle size retained in upper and intermediate layer portions and with fine sinterable substances of a small particle size retained in its lower layer portion as in known manner, and this segregation results from percolation (filtration or penetration) of the sintering material when the latter slidably drops out of a sloping chute. While the sintering material thus facilitated in its particle size segregation through percolation on the sloping chute is being fed from a front end of the latter chute to a pallet, a magnetic force is applied to the sintering material from a cylindrical magnetic drum located downwardly of the sloping chute and having built therein a permanent magnet or an electromagnet such that magnetically susceptible sinterable substances such as highly magnetic mill scale and calcium ferrite-containing returned ore are magnetically attached to an outer periphery of an outward ring constituent of the magnetic drum and then segregated in a lower layer of the sintering material.

The sintering material being moved on to the pallet by means of the magnetic drum is gently charged on the pallet since magnetically susceptible sinterable substances present in the sintering material are magnetized by the action of the permanent magnet or electromagnet built in the magnetic drum and thus caused to drop at low speed. To be more specific, fine particles are relatively susceptible to higher magnetization than coarse particles, and hence, the drop speed is lower as the particle size becomes smaller. For that reason, coarse particles drop earlier and enter a lower portion of the sintering material layer. According to the present invention, in brief, magnetically susceptible sinterable substances are attracted by a magnetic force of the magnetic drum and fine substances of low drop speed are segregated on a side near to an outer periphery of the magnetic drum (in a lower layer portion of the sintering material). Thus, coarse weakly magnetic or non-magnetic sinterable substances are segregated on a side remote from the outer periphery of the magnetic drum (in upper and intermediate layer portions of the sintering material).

The sintering material segregated as stated above is turned upside down during its continued loading on the pallet from the magnetic drum. It is thus ensured that the sintering material have in its upper layer portion magnetically susceptible sinterable substances such as ferrous metal-rich mill scale, calcium ferrite-containing returned ore and the like of high magnetization, and in its intermediate and lower layer portions coarse weakly magnetic or non-magnetic sinterable substances in large amounts. This means that segregation can be attained as desired. In this invention, moreover, part of the sintering material having adhered to the cylindrical magnetic drum having built therein a permanent magnet or an electromagnet is neatly removed by a scraper on to the pallet. Such construction enables a magnetic force to be normally efficiently applied to a flow of sintering material, leading to stable loading of the sintering material on the pallet from the magnetic drum.

Furthermore, it is made possible in this invention to adjust the magnitude of magnetic force of a permanent magnet or electromagnet laid in a magnetic drum, or the revolution number of a magnetic drum having built therein a permanent magnet or an electromagnet. This permits adjustment of, at will, the amounts of magnetically susceptible sinterable substances and fine sinterable substances to be retained in an upper portion of a sintering material layer so as to compensate for irregular grades of sintering materials, i.e., their varying particle size distributions and chemical compositions, and thus contributes greatly to improved sinterability. Hence, the upper layer portion of the sintering material layer is rendered strongly sinterable so that sintering is operable with high yield on a whole.

In the case where a permanent magnet is laid in a magnetic drum, no electricity is necessary with saved unit of electric power unlike the case with a magnetic drum having an electromagnet built therein so that the advantages noted previously are easily achievable at low cost. Because the magnitude of magnetic force of the permanent magnet may be adjusted with the revolution number of the magnetic drum varied, the amount of magnetically susceptible sinterable substances to be retained in an upper portion of a sintering material layer can be easily adjusted with utmost efficiency. When it is found necessary to change sintering conditions to a large extent, it is recommended that replacement be made of a permanent magnet of a varied magnetic force, or of a magnetic drum having built therein a permanent magnet of a varied magnetic force. Owing to its excellent performance, the permanent magnet has a service life of 10 to 20 years, or otherwise warrants almost permanently stable utilization.

In the case where an electromagnet is built in a magnetic drum, operating conditions required for a sintering apparatus used may be easily changed only with electric requirements varied to meet the action of the electromagnet.

EXAMPLE 1

The facets leading to the present invention and several specific embodiments of the invention will be described below in greater detail with reference to the drawings.

To achieve the object of the invention mentioned hereinabove, the present inventors have made research as to various methods of the loading of sintering materials and, as a result, have come to the conclusion that when a sintering material is segregated with highly magnetic ferrous metal-containing mill scale, calcium ferrite-containing returned ore, iron ore and the like in large amounts in an upper layer portion, FeO in the mill scale reacts with $SiO_2$ induced from limestone and iron ore to thereby form a CaO—FeO—$SiO_2$ melt of a low melting point (about 1,180° C.), and due to its high content of FeO, such melt is less viscous and effective to facilitate ore-to-ore bonding.

It has also been concluded that the returned ore contains a great amount of calcium ferrite resulting from reaction of limestone (CaO) with iron ore ($Fe_2O_3$), and the calcium ferrite once reacted is fast in reaction rate and hence capable of undergoing sufficient sintering reaction even in an upper portion of a sintering material layer which is exposed to elevated temperature only for a short time.

Check experiments were conducted with use of a sintering material of a composition for use in producing a conventional sintered ore as shown in Table 1. The sintering material was sintered by means of a DL sintering apparatus equipped with a loading apparatus illustrated in FIG. 1 and by use of powdered iron ore of a hematite type for comparative purposes that, among conventional sintering materials, is most abundant in magnetically susceptible sinterable substances such as highly magnetic mill scale, returned ore containing calcium ferrite and the like so as to determine accessibility to magnetic attraction.

As seen in FIG. 1, a sintering material 2 put in an ore supplying hopper 1 mounted on the DL sintering apparatus is cut by means of a drum feeder 3 and charged through a sloping chute 4 of a plate type onto a pallet 5 disposed to continuously move in a direction indicated by the arrow. Deposition of a sintering material layer 7 is carried out in conventional fashion. In the present invention, disposed downwardly of the sloping chute 4 is a cylindrical magnetic drum 6 having a permanent magnet built therein and having a main scraper 8 and a plurality of sub-scrapers 18 located to abut against an outer periphery of the magnetic drum 6 for removal of deposits of the sintering material. In that figure, four sub-scrapers 18 are shown arranged equidistantly lengthwise and widthwise. Although the main scraper 8 is necessarily disposed on the outer periphery of the magnetic drum 6 on its return side, the sub-scrapers 18 are arranged depending on adherence of the sintering material 2 to the magnetic drum 6. The number and positioning of the sub-scrapers may be decided to match the extent of adhesion of the sintering material.

The sub-scrapers 18 noted here are protuberances located peripherally of the magnetic drum 6. When the protuberances are retracted out of a region in which the permanent magnet 11 is disposed, the sintering material magnetically attached to such magnetic drum is easy to drop therefrom. Thus, the protuberances produce scraping capabilities, bringing about improved resistance to abrasion of the magnetic drum 6.

Figure 2:
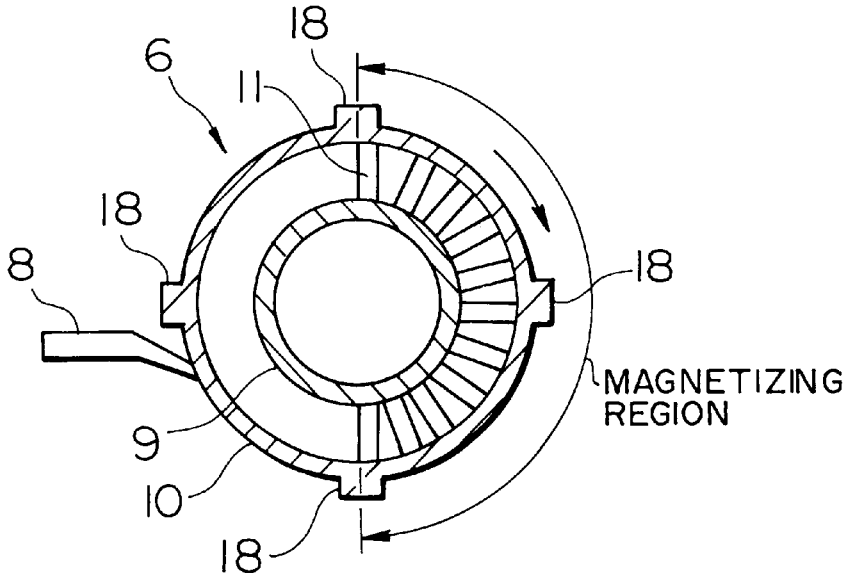
FIG. 2 is a view, as shown vertically cross-sectionally, of a magnetic drum provided therein with a permanent magnet according to the invention.

The cylindrical magnetic drum 6 is constituted, as seen in FIG. 2, with an inward ring 9 and an outward ring 10 held concentrical relation to each other. The inward ring 9 is of an immovable type, but is not restrictive as regards its structural material. Disposed around an outer periphery of the inward ring 9 are a plurality of permanent magnets 11 held adjacent to an inner periphery of the outward ring 10 on a side on which to contact the sintering material 2 being charged from the sloping chute 4. The outward ring 10 has a width sufficient to guide the sintering material 2 being charged from the sloping chute 4 and is made of a non-magnetic material such as ceramic, stainless steel, copper alloy or the like, which is highly resistant to abrasion and is by suitable choice from the viewpoints of life and cost. The outward ring 10 is rotatably driven, by a driving device (not shown), in a direction along which the sintering material is slidably dropped. Such outward ring is magnetic at a region corresponding to the permanent magnets 11 and not magnetic at the remaining region.

The length of a magnetization generating region in which a magnetic force is exerted outwardly of the outward ring 10 from the permanent magnets 11 secured to the immovable inward ring 9 may be suitably set between a position beneath the sloping chute 4 based on the conditions of the sintering material used and a position in which the main scraper 8 is fixed in a non-magnetic region. The inward ring 9 having the permanent magnets 11 held non-rotatably thereon is shown held immovably, but should not be limited thereto. These permanent magnets are not restricted in their fixing means so long as they can be arranged adjacent to the inner periphery of the outward ring 10 in a given number. It is preferred that the magnetic drum 6 be adjustably positioned relative to the sloping chute 4 so that the magnetic drum 6 can be adjusted, where desired, to lie at an optimum position to meet with different conditions of the sintering material 2 being charged from the sloping chute 4.

The sintering material 2 cut out of the ore supplying hopper 1 by means of the drum feeder 3 and deposited on the sloping chute 4 has coarse particles contained in its upper and intermediate layer portions and fine particles contained in its lower layer portion and is caused to move as such toward the magnetic drum 6. In the present invention, magnetically susceptible substances such as highly magnetic mill scale are easy to be attracted to the permanent magnets 11, returned ore and the like are magnetically attached to the outward ring 10 through the permanent magnets 11 arrayed in the magnetic drum 6.

Figure 4:
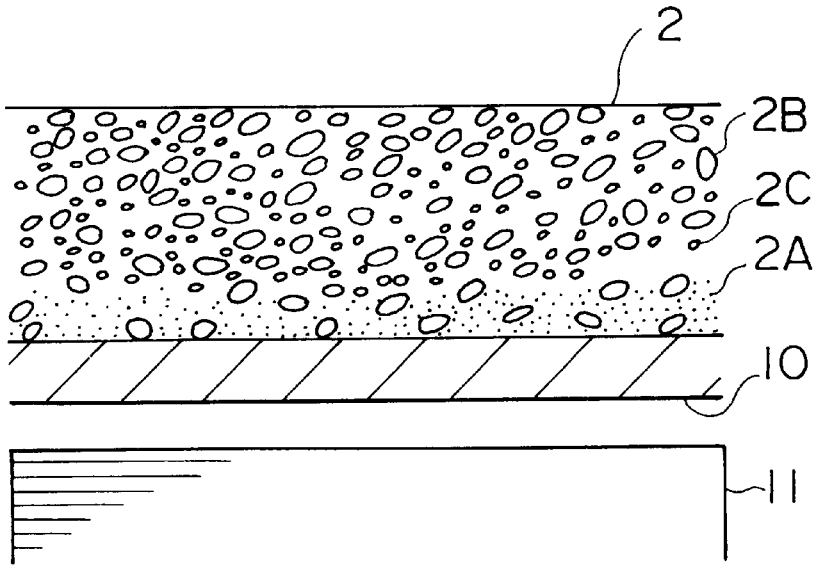
FIG. 4 is a partly cross-sectional view showing the manner in which highly magnetic substances are magnetically attached to a magnetic drum having built therein a permanent magnet according to the invention.

Namely, magnetically susceptible substances such as mill scale, returned ore and the like are attracted to the permanent magnets 11 as illustrated in FIG. 4, and the resultant segregated substances 2A such as magnetically susceptible substances and fine substances of low drop speed pass through main coarse substances 2B such as hematite, limestone and the like and weakly magnetic substances 2C toward the outward ring 10 and become magnetically attached. In consequence, the sintering material 2 is further segregated in that magnetization generating region and hence is enhanced in its segregation.

Because of such facilitated segregation through a magnetic force of the magnetic drum 6, the magnetically susceptible substances 2A so segregated, such as highly magnetic mill scale, returned ore and the like as well as fine substances of low drop speed, are situated in the magnetization generating region of the outward 10, and the coarse substances 2B and weakly magnetic substances 2C are situated in the upper and intermediate portions. Since the sintering material 2 enhanced in its segregation by the magnetic drum 6 is turned upside down when the former is guided into a non-magnetic region of the outward ring 10 and then charged on the pallet 5, a sintering material layer 7 charged on the pallet 5 is placed in segregated condition with magnetically susceptible sinterable substances and fine substances of low drop speed present in large amounts in an upper layer portion 7A and with coarse and weakly magnetic substances present in large amounts in intermediate and lower layer portions 7B.

In that instance, if the magnitude of magnetic force has been previously set to meet the target amount of magnetically susceptible sinterable substances to be contained in the upper portion 7A of the sintering material layer 7 deposited on the pallet 5, such substances can be maintained at a targeted amount. Here, the magnitude of magnetic force can be adjusted by varying the strength of a magnetic field constituted by the permanent magnets 11, by varying the positioning of such magnets with respect to the magnetic drum, or by varying the positioning of such magnets with respect to the sloping chute. In addition, the revolution number of the magnetic drum 6 when varied allows for adjustment of the magnetically susceptible sinterable substances to a target amount. Part of the sintering material having been adherent to the outward ring 10 is removed by the main scraper 8 located in a non-magnetic region and is dropped and recovered on the pallet 5 as arrowed. This removal may be done also by the sub-scrapers 18 when needed.

The sintering material layer 7 so formed from the sintering material 2 by means of the magnetic drum 6 has contained in its upper portion 7A large amounts of magnetically susceptible sinterable substances of high magnetization such as mill scale, iron ore and the like, and FeO in the mill scale reacts with $SiO_2$ resulting from limestone and iron ore to thereby form a melt of CaO—FeO—$SiO_2$ having a low melting point (about 1,180° C.). The resulting melt has a high content of FeO and shows a low viscosity and thus facilitates bonding between ores. Moreover, contained in the returned ore is a large amount of calcium ferrite that was derived from reaction of limestone (CaO) and iron ore ($Fe_2O_3$), and the calcium ferrite having already undergone reaction has a fast reaction rate and thus makes a sufficient sintering reaction even in the upper portion 7A that maintains high temperature for a limited length of time. Hence, the strength of the upper portion 7A of the sintering material layer 7 can be enhanced together with the strength of the intermediate and lower portions 7B with the result that the finished sintered ore is rendered strong on a whole.

In Table 2, there is shown the formulation of the sintering material used.

Figure 5:
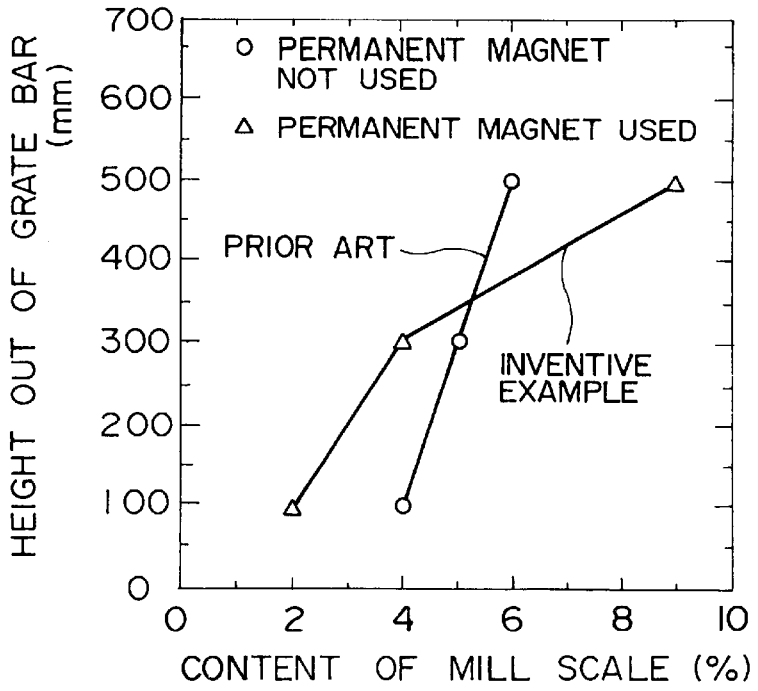
FIG. 5 represents a line graph of the height (mm) out of a grater bar as plotted against the content (%) of mill scale with respect to an inventive example as compared to a prior art example.
Figure 6:
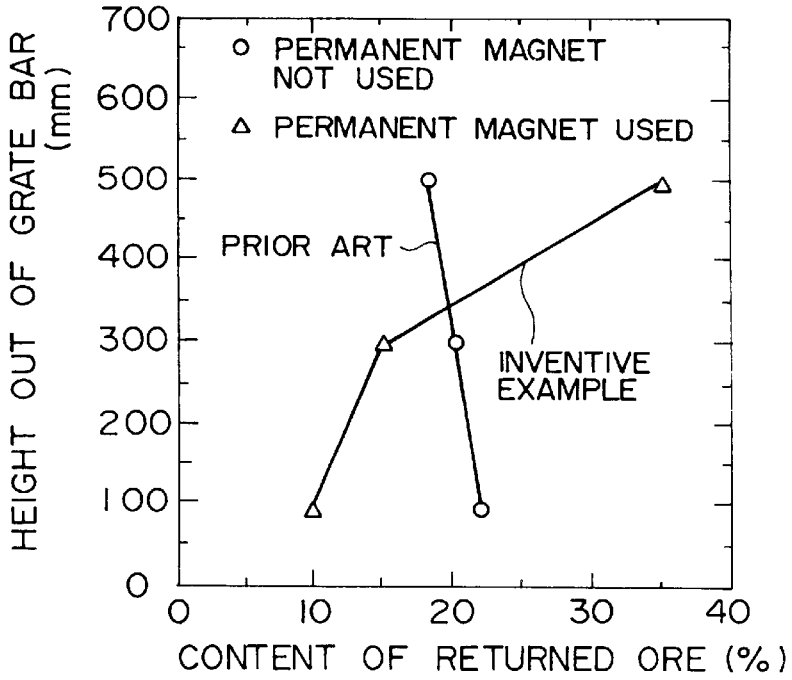
FIG. 6 represents a line graph of the height (mm) out of a grater bar as plotted against the content (%) of returned ore with respect to an inventive example as compared to a prior art example.
Figure 7:
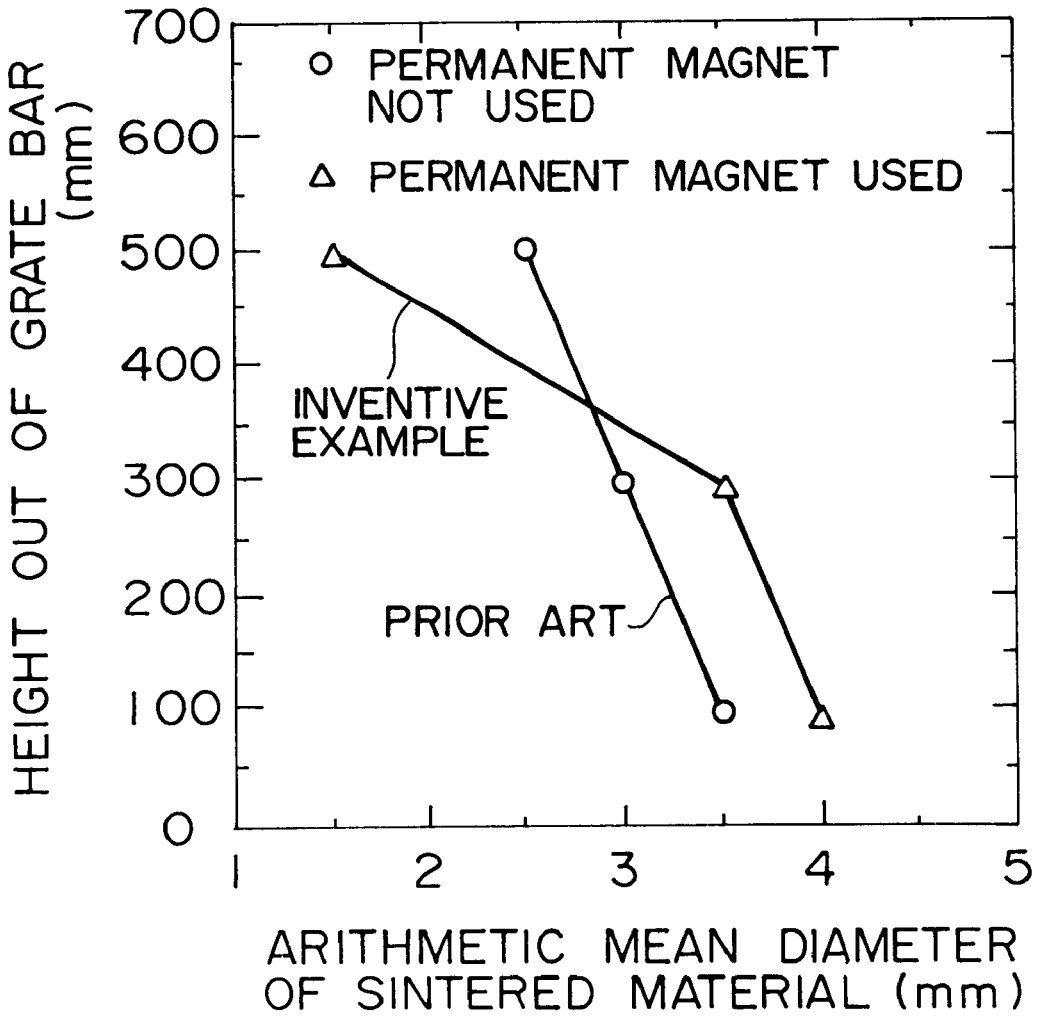
FIG. 7 represents a line graph of the height (mm) out of a grater bar as plotted against the arithmetic mean diameter (mm) of a sintering material with respect to an inventive example as compared to a prior art example.

The results of this check operation, as seen in FIGS. 5, 6 and 7, are directed to the present invention in which a cylindrical magnetic drum 6 with a permanent magnet 11 built therein is disposed downwardly of a sloping chute of a plate type as compared to a prior art case in which a plate-type sloping chute only is used with a magnetic drum omitted.

As evidenced by the content (%) of mill scale relative to the height out of a grate bar of a sintering material layer (FIG. 5), the content (*) of returned ore relative to such height (FIG. 6) and the arithmetic mean diameter (mm) relative to such height (FIG. 7), this invention enables more of magnetically susceptible sinterable substances such as mill scale, returned ore, FeO-containing material and the like as well as fine material to be segregated in an upper portion of the sintering material layer 7 and more of weakly magnetic material, non-magnetic material and coarse material to be segregated in intermediate and lower portions than the prior art case.

In the present invention, electromagnets 12 each made by winding a coil around an iron core may be secured, in place of the permanent magnets, to an inward ring 9 constituent of the magnetic drum 6. Also in such instance, an outward ring 10 is rendered non-magnetic and may likewise be provided with a main scraper 8 and if necessary with sub-scrapers 18. The number of the electromagnets 12 to be placed in an on-signal mode through current application may be selected so that the length of a magnetization generating region around the outward ring 10 is adjusted at will. Provision of a demagnetization region on a return side, where desired, makes easily removable the sintering material having adhered to the magnetic drum. In such instance, the electromagnets 12 are preferably in an alternate magnetic field in which the material particles once magnetically attached is easy to be removed with excellent sintering operation.

Figure 3:
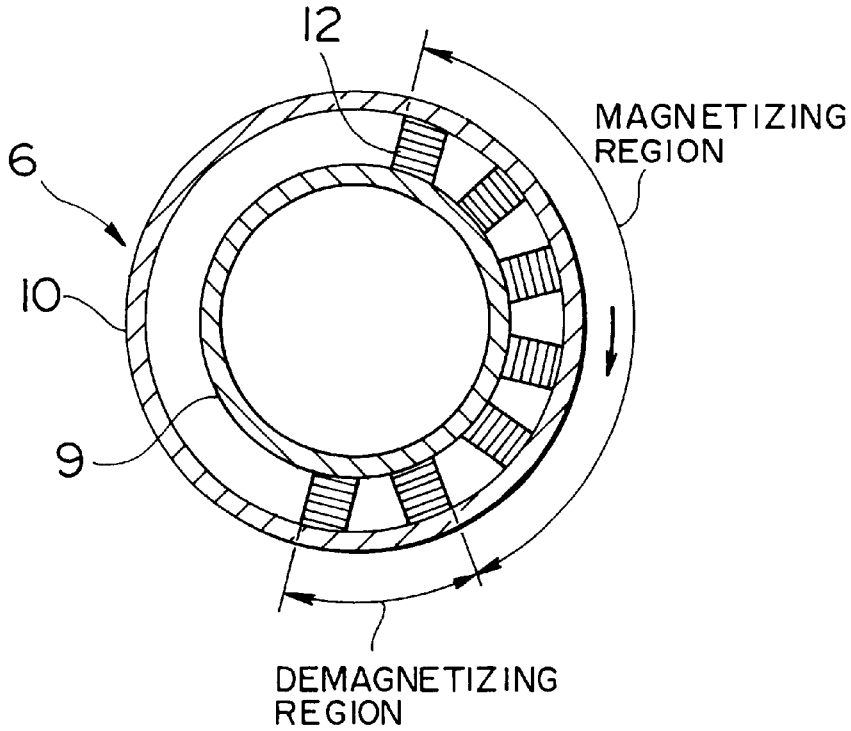
FIG. 3 is a view, as shown vertically cross-sectionally, of a magnetic drum provided therein with an electromagnet according to the invention.

Also in the case of use of a magnetic drum having built therein electromagnets as shown in FIG. 3, operations and advantages similar to those noted above in connection with FIGS. 1 and 2 are achievable, and therefore, no further explanation will be necessary.

By the use of the sintering material shown in Table 2, a method of sintering material loading according to the present invention and a loading method of the prior art were carried out so as to inspect performance results of both methods from their sinterability standpoints.

In the sintering material loading method of this invention, a sintering material loading apparatus illustrated in FIGS. 1 and 2 was employed. The sintering material 2 of Table 2 was cut from an ore supplying hopper 1 by means of a drum feeder 3 and deposited on a pallet by a sloping chute 4 and a magnetic drum 6. Magnetically susceptible sinterable substances such as mill scale, returned ore and the like as well as fine sinterable substances were segregated in an upper portion of a sintering material layer 7. The strength of a magnetic field of a permanent magnet 11 was set to be at 2,000 Gauss. The outer diameter of the magnetic drum 6 was 400 mm.

Figure 8:
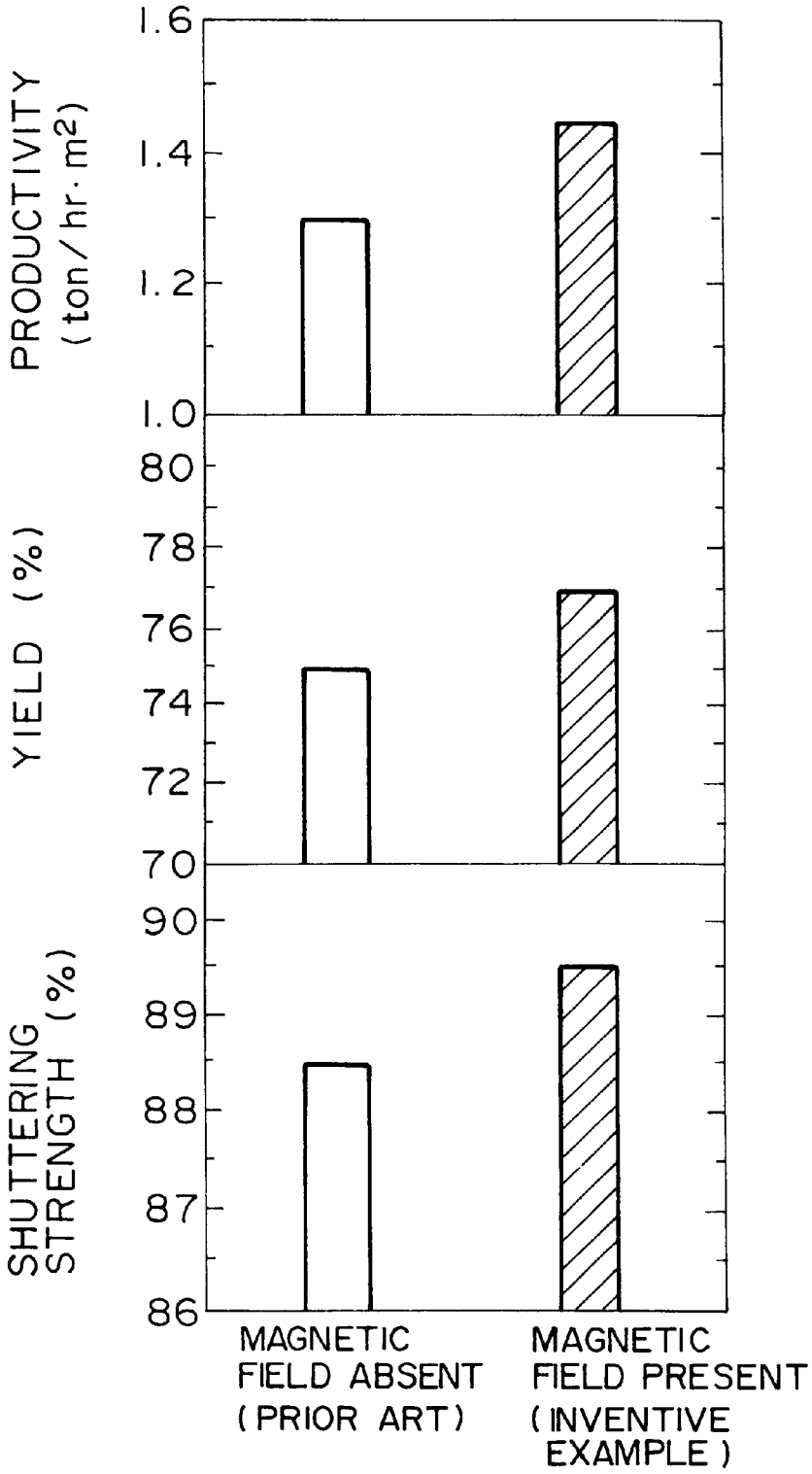
FIG. 8 represents line graphs, respectively, of the productivity (t/hr.m$^2$), the yield (%) and the shuttering strength (%) of a sintered ore obtained by the invention as compared to the prior art.
Figure 20:
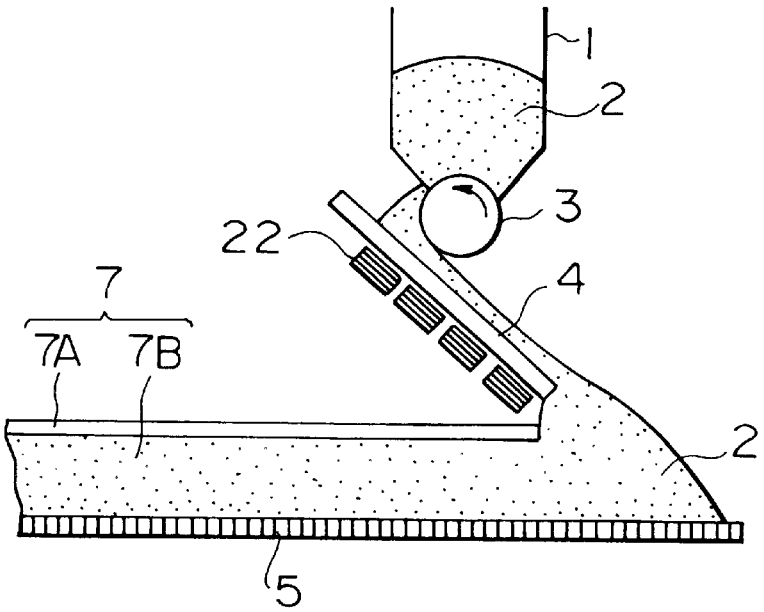
FIG. 20 is a vertically cross-sectional view showing an embodiment of the invention in which a plurality of rectangular permanent magnets are arrayed backwardly of a sloping chute and in side-by-side relation to each other.

In the sintering material loading method of this invention, the sintering material having been adherent to a surface of the magnetic drum 6 was removed with use of the main scraper 8 and also of the sub-scrapers 18 of four in number. The magnitude of a magnetic force of the permanent magnet 11 built in the magnetic drum 6 was previously adjusted to meet the target amounts of magnetically susceptible sinterable substances and fine substances of the sintering material 2 to be deposited on the pallet 5, and the revolution number of the magnetic drum 6 was also adjusted on-line. Sinterability was evaluated of the method wherein use was made of the magnetic drum 6 provided therein with the permanent magnet according to this invention as compared to the prior art method wherein only a plate-type sloping chute was used with no such drum as illustrated in FIG. 20. Evaluation was made, as shown in FIG. 8, for three items of the productivity of and the yield of a finished sintered ore and the shuttering strength as a measure of the strength of a sintered ore. In this experiment, however, the proportions of coke dust and limestone were held constant. As is clear from FIG. 8, the method of the present invention shows a greater rise in shuttering strength than the prior art method and further contributes to improved productivity and yield of a sintered ore. In comparison with the prior art method, the advantages of the invention is conspicuous and conducive to improvements in yield of a sintered ore and in various units.

EXAMPLE 2

Other embodiments of the present invention will be described below with reference to the drawings.

Figure 9:
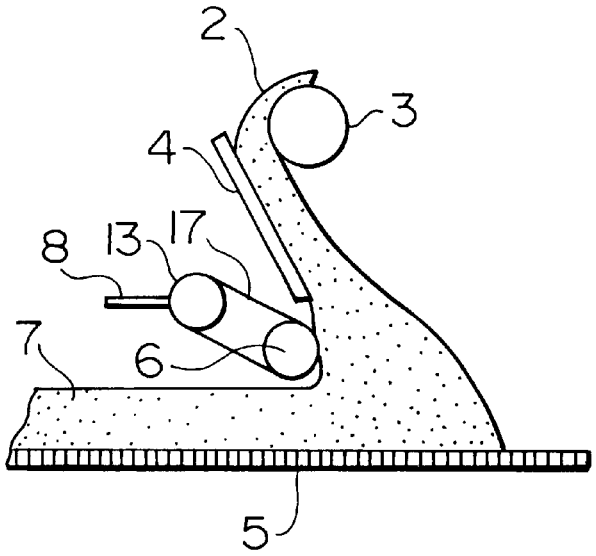
FIG. 9 is a side-elevational view showing an embodiment of the invention in which an endless belt is held in interengaged relation to a magnetic drum on a driving side and to a drum on a driven side.

In the invention, as shown in FIG. 9, a drum 13 is disposed on a driven side in opposed relation to the magnetic drum 6 provided therein with a permanent magnet 11 or an electromagnet 12 and located on a driving side, and an endless belt 17 is arranged to engage with the magnetic drum 6 and with the driven drum 13. A main scraper 8 is fixed in abutting relation to the endless belt 17 at a part of the driven drum 13. In this instance, magnetically susceptible sinterable substances of high magnetization of a sintering material 2 are magnetically attached to the magnetic drum 6 through the endless belt 17, and fine substances of low drop speed are segregated as mentioned hereinabove.

According to this construction, the sintering material 2 does not attach directly to the magnetic drum 6, while such material having been adherent to the endless belt 17 is reliably removed by the main scraper 8 located on a side where the driven drum is situated and then recovered on the pallet 5. Sub-scrapers cannot be employed in such construction since the endless belt 17 is required to be engaged with the magnetic drum 6.

EXAMPLE 3

Figure 10:
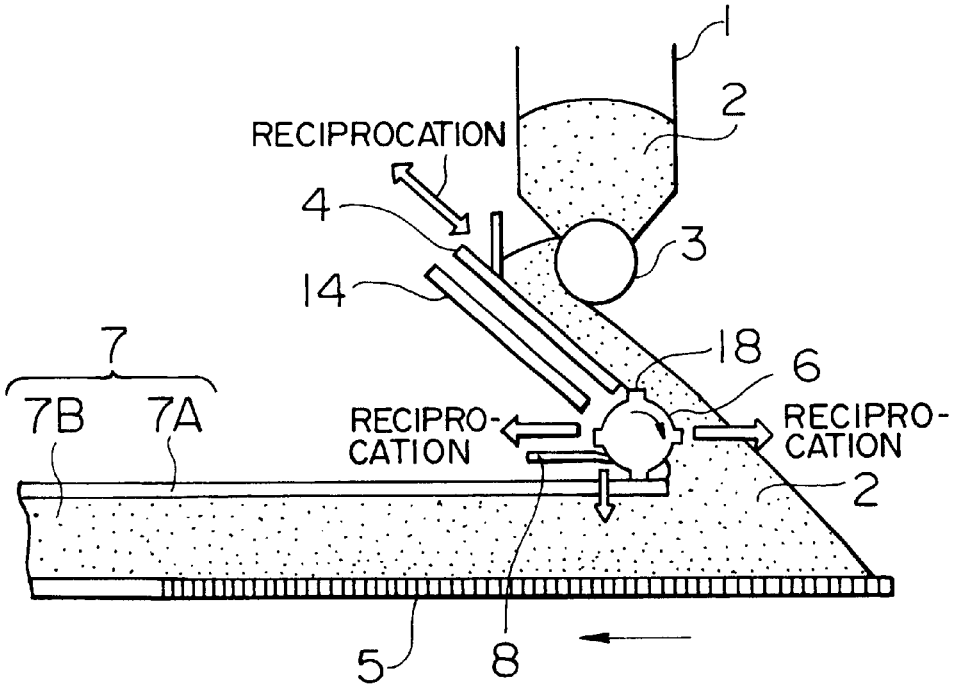
FIG. 10 is a vertically cross-sectional view showing an embodiment of the invention in which an ancillary sloping chute is disposed beneath a normally used sloping chute and in parallel spaced relation to the latter, and a magnetic drum is arranged to lie downwardly of the two sloping chutes and to reciprocate forward and backward.

A sintering material loading apparatus shown in FIG. 10 for use in this invention is concerned with a construction wherein an ancillary sloping chute 14 is disposed beneath a normally used sloping chute 4 and in parallel spaced relation to the latter, and a sintering material 2 cut from an ore supplying hopper 1 by means of a drum feeder 3 is fed, by changeover of the two, upward and downward, sloping chutes 4, 14, to a magnetic drum 6 having built therein a permanent magnet 11 or an electromagnet 12. The upward normal sloping chute 4 is arranged to be upwardly slantly movable as indicated by the arrow and hence to be reciprocative between its operative position and its retractive position.

The upward sloping chute 4 is normally used and displaced at a cycle of once or so per 30 minutes from the operative position to the retroactive position in which the sintering material having adhered to such chute is removed by a scraper separately disposed (not shown). During this scraping operation, the downward ancillary sloping chute is used. In such case, the path of slidably dropping of the sintering material 2 gets varied when the latter cut by the drum feeder 3 is moved through the ancillary sloping chute 14 to the magnetic drum 6.

To follow the varied path of dropping, the magnetic drum 6 is arranged to horizontally reciprocate forward and backward as indicated by the arrow in FIG. 10 so that simultaneously with displacement of the upward sloping chute 4 toward the retractive position, the magnetic drum 6 is moved to the left. By this arrangement, those conditions necessary for the sintering material 2 charged on the magnetic drum 6 from the downward sloping chute 14 are adjusted to be of the same as in the case with the upward sloping chute 4 used.

As a result, with the magnetically susceptible sinterable substances in the sintering material 2 retained in their desirable adhesion to the magnetic drum 6, loading of that material can be continued to the pallet 5 from the magnetic drum 6. After completion of the scraping operation, in the retractive position, of the sintering material having adhered to the upward sloping chute, the latter chute is immediately returned to the operative position, and the magnetic drum 6 is moved to the right and returned to the initial position. Thus, the sintering material 2 is originally loaded through the usual path of dropping to the magnetic drum 6 from the upward sloping chute 4. Needless to say, therefore, the sintering material 2 can be segregated by the magnetic drum 6 in such a way as stated above.

EXAMPLE 4

Figure 11:
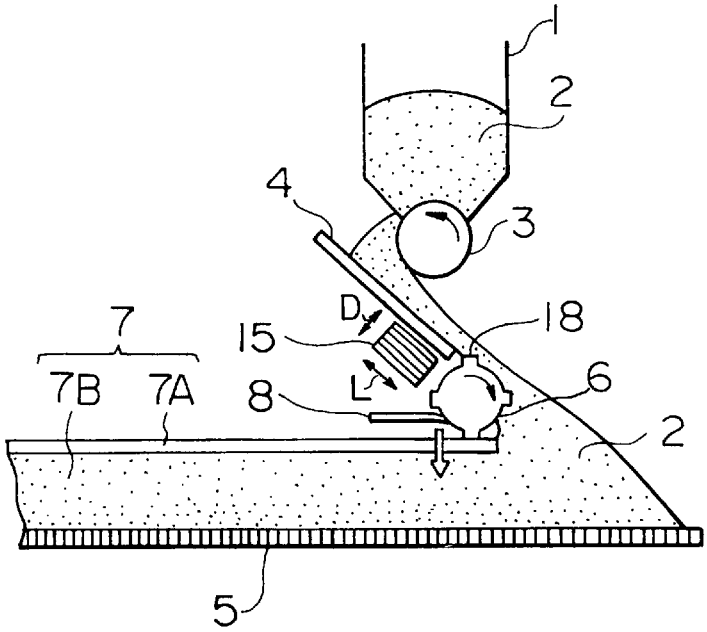
FIG. 11 is a vertically cross-sectional view showing an embodiment of the invention in which a rectangular permanent magnet is located backwardly downwardly of a sloping chute, and a magnetic drum is placed downwardly of that permanent magnet.

A sintering material loading apparatus shown in FIG. 11 for use in this invention is concerned with a construction wherein an inexpensive rectangular permanent magnet 15 of a low magnetic force in the range of about 300 Gauss to 1,000 Gauss is located backwardly downwardly of a plate-type sloping chute 4 so as to reduce the speed at which to slidably drop a sintering material 2 out of the above chute 4. A magnetic drum 6 provided therein with a permanent magnet 11 or an electromagnet 12 is of course disposed downwardly of the sloping chute 4. The permanent magnet 15 is structured to be of a length L=30 mm–100 mm, a thickness D=30 mm–50 mm and a magnetic force=300 Gauss–1,000 Gauss. As this rectangular permanent magnet, there may be used a permanent magnet for example of a $BaO.Fe_2O_3$ type.

The price of such permanent magnet 15 is 1/7–1/10 times that of a permanent magnet of 3,000 Gauss to be disposed for example in a magnetic drum 6 and hence can be installed at extremely low cost. The rectangular permanent magnet 15 is constructed to be adjustable by its positional change relative to the sloping chute 4. An electromagnet may be thought to be arranged at a place at which to locate the above permanent magnet, but it is unsuitable to do so at such place of forcedly limited space as the electromagnet is of a dimensionally large device.

The speed of the sintering material 2 to be slidably dropped out of the sloping chute 4 is reduced by applying, from the permanent magnet 15 located downwardly of the sloping chute 4, a magnetic force to the sintering material 2 cut from an ore supplying hopper 1 by use of a drum feeder 3 and being dropped from the sloping chute 4. To this end, the magnitude of magnetic force is adjusted by positionally changing the permanent magnet 15 in proportion to the drop speed of the sintering material 2. Namely, the magnetic force of the permanent magnet 15 is made large when the drop speed is large, whereas such magnetic force is small when the drop speed is small, and hence, the drop speed reduction is conducted to match the varying drop speeds.

Since the sintering material 2 being moved from a tip of the sloping chute 4 to the magnetic drum 6 is reduced in its drop speed, magnetically susceptible sinterable substances are magnetically attached with higher efficiency to the magnetic drum 6 so that the sintering material 2 is segregated to a greater degree. The sintering material 2 further facilitated in its segregation is gently charged at a reduced drop speed on a pallet 5 from the magnetic drum 6 with the result that a sintering material layer 7 deposited on the pallet 5 is rendered low in its loading density and permeable to air with improved sinterability.

EXAMPLE 5

Figure 12:
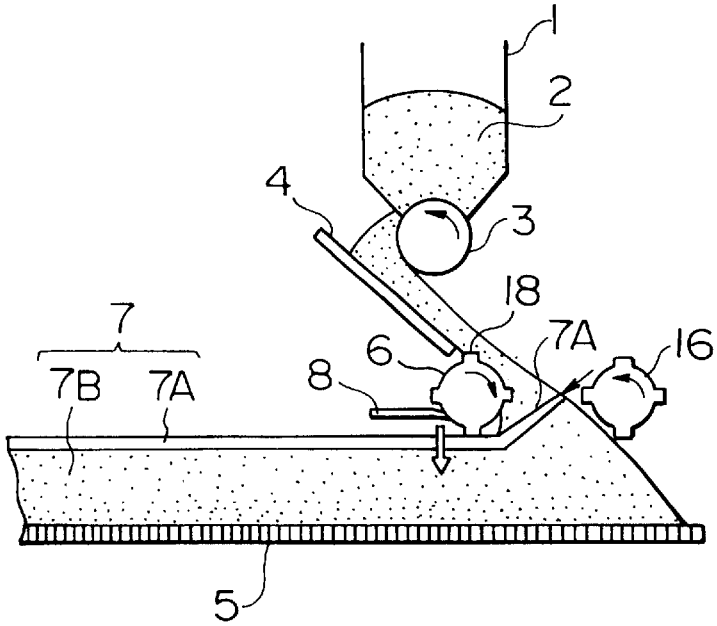
FIG. 12 is a vertically cross-sectional view showing an embodiment of the invention in which an auxiliary magnetic drum is disposed in opposed relation to a magnetic drum located downwardly of a sloping chute.
Figure 13:
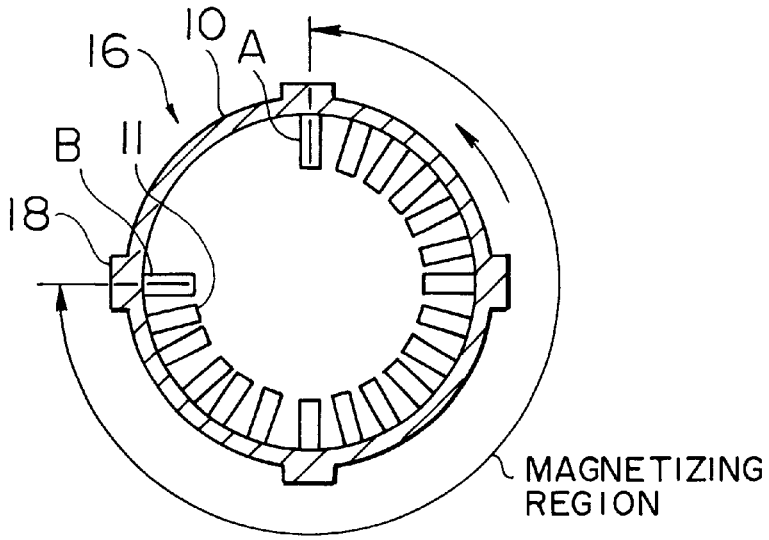
FIG. 13 is a view, shown vertically cross-sectionally, of the auxiliary magnetic drum of FIG. 12.

A sintering material loading apparatus shown in FIG. 12 for use in the present invention is concerned with a construction wherein an auxiliary magnetic drum 16 is disposed forwardly (on an upstream side) of and oppositely to a magnetic drum 6 located downwardly of a plate-type sloping chute 4. The auxiliary magnetic drum 16 is basically similar in structure to the magnetic drum 6 illustrated in FIG. 2 (a permanent magnet built-in) and in FIG. 3 (an electromagnet built-in). For example, as seen in FIG. 13, a plurality of permanent magnets 11 are arrayed adjacent to an inner periphery of an outward ring 10 without resort to a non-rotatable or fixed inward ring 9 shown in FIG. 2. The extent in which the permanent magnets 11 are laid adjacent to the inner periphery of the outward ring 10 is widely defined as a magnetization generating region in a ¾ circumference ranging from a top end point A on a right side to a left-hand point B via a bottom portion. In the auxiliary magnetic drum 16, the outward ring 10 is arranged to rotate opposite to the magnetic drum 6.

A sintering material 2 passing and dropping between the magnetic drum 6 and the auxiliary drum 16 is first magnetically attached through a magnetic force generating from the magnetic drum 6. The sintering material having failed to be magnetiqally attached to the magnetic drum 6 is once again magnetically attached through a magnetic force in a magnetization generating region defined by the auxiliary magnetic drum 16. This leads to aided segregation of the sintering material, hence enhanced segregation. During charging from the magnetic drum 6 to a pallet 5, the upper and lower segregated layer portions of the sintering material are turned upside down and deposited on the pallet 5, and the resulting sintering material layer 7 can be enhanced in its upper portion 7A wherein magnetically susceptible sinterable substances and fine substances of low drop speed are retained in large amounts.

EXAMPLE 6

Figure 14:
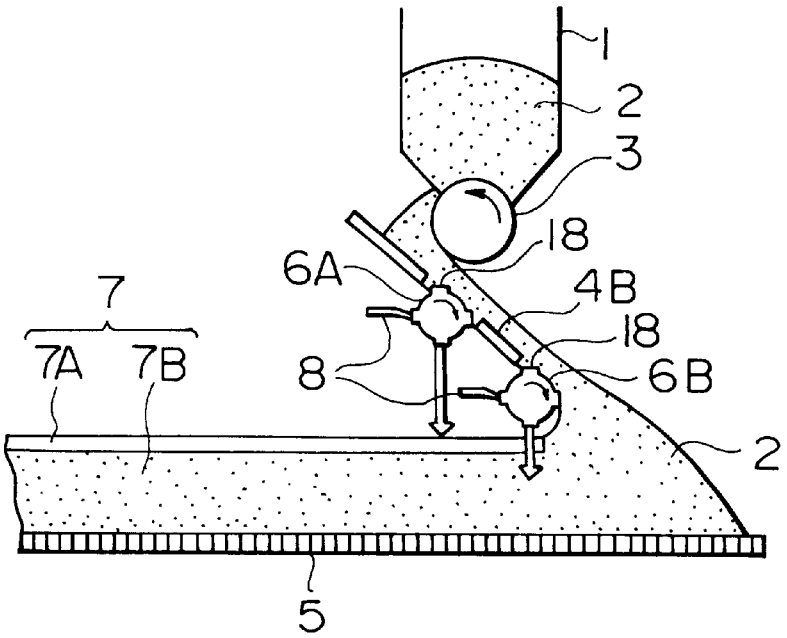
FIG. 14 is a vertically cross-sectional view showing an embodiment of the invention in which a first-stage magnetic drum is located downwardly of an upstream sloping chute, and a second-stage magnetic drum is located downwardly of a downstream sloping chute.
Figure 15:
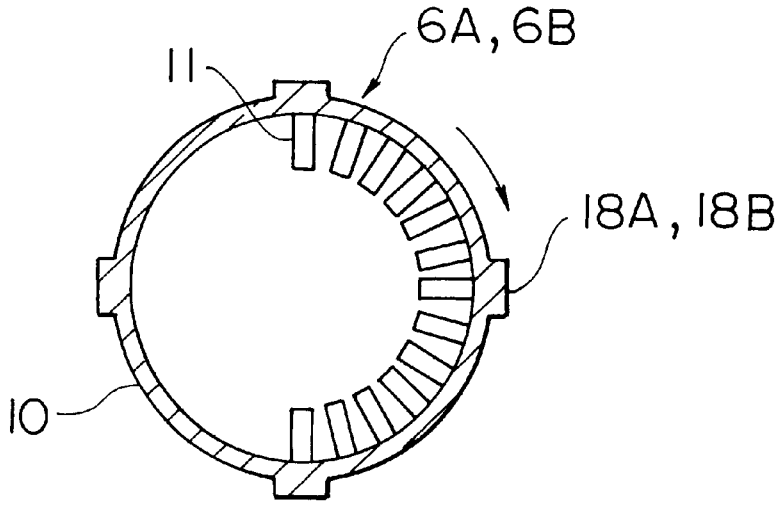
FIG. 15 is a view, as shown vertically cross-sectionally, of each of the magnetic drums of FIG. 14.

A sintering material loading apparatus shown in FIG. 14 for use in this invention is concerned with a construction wherein a first-stage magnetic drum 6A located downwardly of an upstream sloping chute 4A and a second-stage magnetic drum 6B located downwardly of a downstream sloping chute 4B are serially connected in a two-stage formation. Each of the magnetic drums 6A, 6B, as shown in FIG. 15, is similar in structure to that illustrated in FIG. 2 or 3, and hence, no further explanation is believed needed. Each such magnetic drum is provided with a main scraper 8 and if necessary with sub-scrapers 18. This construction Is suitably applicable to those equipment conditions which are capable of a great head ranging from a drum feeder 3 to a pallet 5. Three stages or more may also be acceptable.

The sintering material 2 cut by the drum feeder 3 from an ore supplying hopper 1 is first segregated, by particle size segregation through percolation during slidably dropping from the first-stage sloping chute 4A, with coarse particles contained in upper and intermediate layer portions and with fine particles contained in a lower layer portion and then is moved to the magnetic drum 6A. Of the sintering material 2, as shown in FIG. 15, magnetically sinterable material is magnetically attached to an outward ring 10 through a magnetic force of the permanent magnet 11 so that segregation is facilitated. Thereafter, the sintering material 2 is moved to the sloping chute 4B.

Next, the sintering material 2 dropping from the sloping chute 4B is exposed to facilitated repeated segregation of its particle sizes through percolation and then is moved to the second-stage magnetic drum 6B where magnetically susceptible sinterable material is facilitated in its segregation, after which the sintering material 2 is charged on the pallet 5. By this construction, the sintering material 2 is segregated twice so that the segregation is further enhanced. Thus, it is made possible to segregate, to a greater degree, magnetically susceptible sinterable material and fine material of low drop speed in an upper portion 7A of a sintering material layer 7 with improved sinterability.

Figure 16:
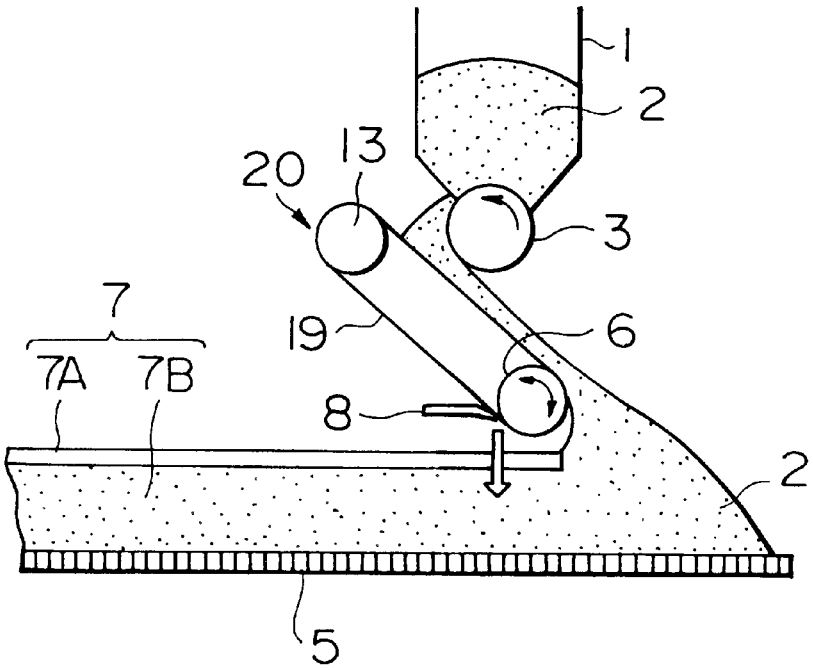
FIG. 16 is a vertically cross-sectional view showing an embodiment of the invention in which a belt conveyor-type sloping chute is disposed below a drum feeder with an endless belt interengaged with a magnetic drum on a driving side and with a drum on a driven side.

A certain method is known in which a sintering material is charged on a pallet with the particle sizes segregated through percolation by reduction of the drop speed of the sintering material with use of a belt conveyor-type sloping chute in place of a sloping chute. The belt conveyor-type sloping chute is disposed in a slant posture and is allowed to rotate opposite to a dropping direction of the sintering material. In the present invention, a forward- or backward-rotatable belt conveyor-type sloping chute 20 is disposed downwardly of a drum feeder 3 and at a given angle like a sintering material loading apparatus shown in FIG. 16. The belt conveyor-type sloping chute has disposed on its driving side a permanent magnet 11 or an electromagnet 12 and also has a driven drum 13 located opposite to the magnetic drum 6 and directed slantly upwardly. An endless belt 19 is engaged with the magnetic drum 6 and with the driven drum 13, and a main scraper 8 is fixed to abut against the endless belt 19 at a part of the magnetic drum 6.

Figure 17:
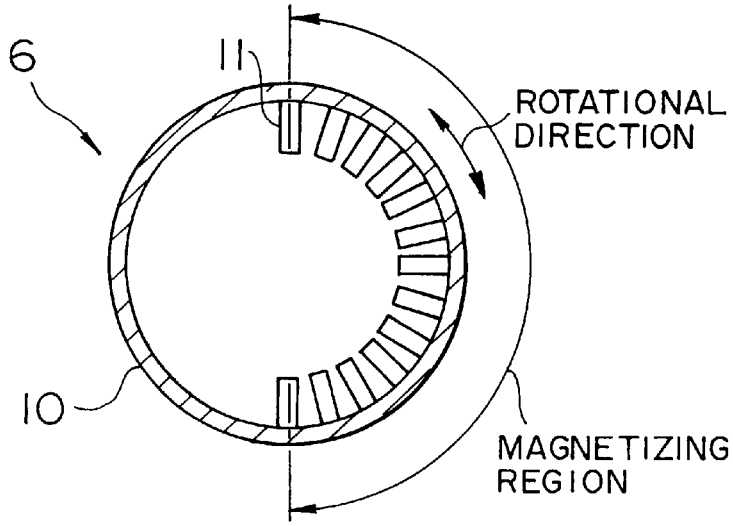
FIG. 17 is a view, as shown vertically cross-sectionally, of the magnetic drum of FIG. 16.
Figure 18:
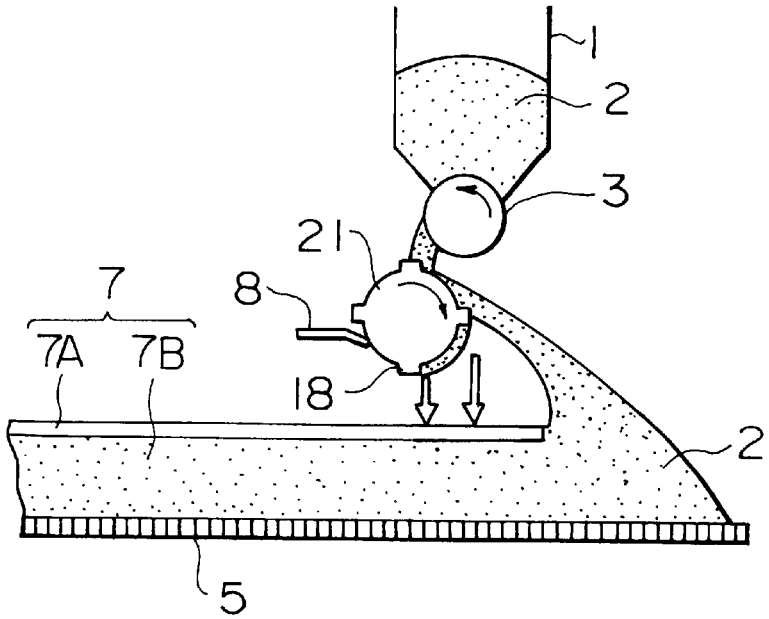
FIG. 18 is a vertically cross-sectional view showing an embodiment of the invention in which a magnetic drum is positioned below a drum feeder.

The structure of the magnet drum 6 is essentially similar to that shown in FIG. 2 (a permanent magnet built-in) and in FIG. 3 (an electromagnet 12 built-in), but no sub-scrapers are fixed owing to interengagement of the endless belt 19 with such magnetic drum as illustrated in FIG. 17. The magnetic drum 6 is rotatable forward and backward as indicated by the arrow in that figure so as to adjust the speed of the sintering material dropping out of the endless belt 19. Rotation of the magnetic drum 6 in the same direction as the dropping direction of the sintering material 2 permits a high drop speed of such sintering material, whereas opposite rotation results in a low drop speed. The rotation direction and rotation speed are adjusted to be optimum by observing the manner in which the sintering material is segregated.

In such instance, the sintering material 2 cut from an ore supplying hopper 1 is moved to a part of the magnetic drum 6 with fine particles segregated in a lower layer portion and with coarse particles segregated in upper and intermediate layer portions by particle size segregation through percolation when the sintering material 2 is slidably dropped out of the endless belt 19 of the belt conveyor-type sloping chute 20. Here, magnetically susceptible sinterable material of the sintering material 2 is magnetically attached to an outward ring 10 in a magnetization generating region defined by the permanent magnet 11 built in the magnetic drum 6 as shown for example in FIG. 17. Thus, magnetically susceptible sinterable material and fine material of low drop speed are segregated, in such a manner as stated above, in an upper portion 7A of a sintering material layer 7 deposited on the pallet 5. The aforementioned operations and advantages are likewise attained. The sintering material having adhered to the endless belt 19 is removed by a main scraper 8 disposed on a return side of the magnetic drum 6 and then dropped over the sintering material layer 7 deposited on the pallet 5.

Figure 19:
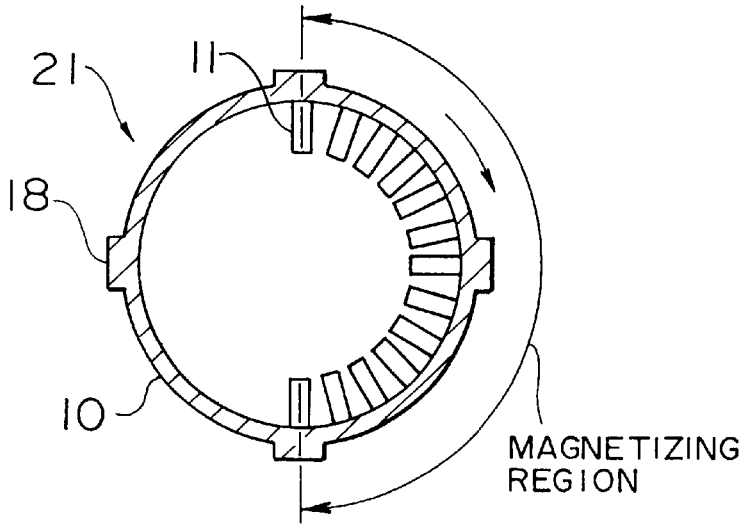
FIG. 19 is a view, as shown vertically cross-sectionally, of the magnetic drum of FIG. 18.

On the other hand, another certain method is known in which a sintering material 2 is loaded on a pallet with use of a drum chute in place of a plate-type sloping chute, which drum chute is rotated in the same direction as in loading the sintering material. In the present invention, a magnetic drum 21 is disposed downwardly of a drum feeder 3, the magnetic drum 21 acting as a drum chute, and a main scraper 8 and if necessary sub-scrapers 18 are arranged in abutting relation to an outer periphery of the magnetic drum 21. The structure of the magnetic drum 21 is virtually the same as in FIG. 2 (permanent magnet) and in FIG. 3 (electromagnet). As depicted for example in FIG. 19, a permanent magnet 11 is arranged adjacent to an inner periphery of the outward ring 10 such that a magnetization generating region is defined.

In this construction, the sintering material 2 cut by a drum feeder 3 from an ore supplying hopper 1 is moved to the magnetic drum 21 where magnetically susceptible sinterable material is magnetically attached to the outward ring 10 in the magnetization generating region defined by the permanent magnet 11 built in the magnetic drum 21 so that magnetically susceptible sinterable material of low drop speed is segregated in a lower layer portion and coarse sinterable material in upper and intermediate layer portions. At this time, adjustment of the revolution number or magnetic force of the magnetic drum 21 makes it possible to adjust the target amounts of magnetically susceptible sinterable material and fine material to be segregated in a lower layer portion during charging of the sintering material 2.

The sintering material 2 thus segregated is turned upside down while in charging on the pallet 5 from the magnetic drum 21, and thus, the resultant sintering material layer 7 deposited on the pallet 5 contains large amounts of magnetically susceptible sinterable material and fine material in its upper portion 7A and large amounts of weakly magnetic or non-magnetic sinterable material and coarse material in its intermediate and lower portions 7B. Hence, sinterability of the upper portion 7A of the sintering material layer 7 can be improved in the same manner already noted above.

EXAMPLE 7

A sintering material loading apparatus shown in FIG. 20 for use in the present invention is concerned with a construction wherein a plurality of rectangular permanent magnets 22 are serially located backwardly of a plate-type sloping chute 4 and directed to a dropping direction of the sintering material 2. The permanent magnets 22 are of a rectangular parallelopiped shape, and their magnetic forces are adjusted to correspond to a position in which the sintering material 2 is dropped from the sloping chute 4. For example, four permanent magnets 22 are arranged on a back side of the sloping chute 4 and with magnetic forces of 200, 300, 500 and 800 Gauss, respectively, from top to bottom, and the strength of a magnetic field may be progressively downwardly increased.

In this construction, the sintering material 2 cut from an ore supplying hopper 1 is progressively magnetically attached through the magnetic action of the four permanent magnets 22 with different magnetic forces when such sintering material is dropped from the sloping chute 4, and then is moved downwardly so that fine particles are segregated in a lower portion by means of segregation through percolation of the sintering material 2. The lowermost permanent magnet is up to 1,500 Gauss for sufficient magnetic attraction. Segregated in upper and intermediate layer portions of the sintering material 2 dropped from the sloping chute 4 are weakly magnetic or non-magnetic sinterable material and coarse sinterable material. When charged directly on a pallet 5 from the sloping chute 4, the sintering material 2 is turned upside down so that the resultant sintering material layer 7 deposited on the pallet 5 has magnetically susceptible sinterable material and fine material segregated in an upper portion 7A and weakly magnetic or non-magnetic material and coarse material segregated in intermediate and lower portions 7B. The advantages obtained here are the same as in the above stated embodiments.

Figure 21:
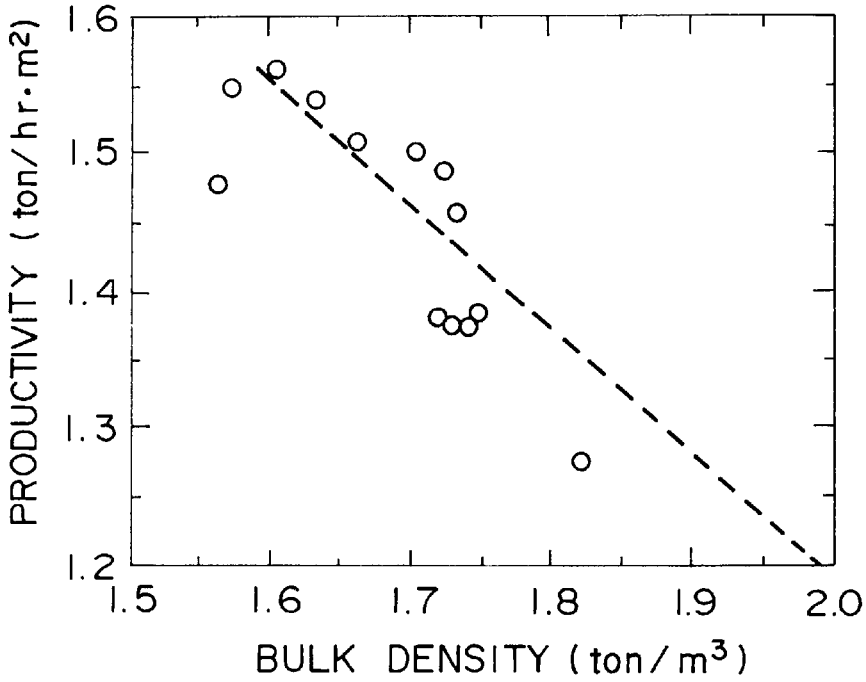
FIG. 21 graphically represents the relationship between the bulk density (ton/$m^3$) of a sintering material layer and the productivity (ton/hr.$m^2$) of a sintered ore.
Figure 22:
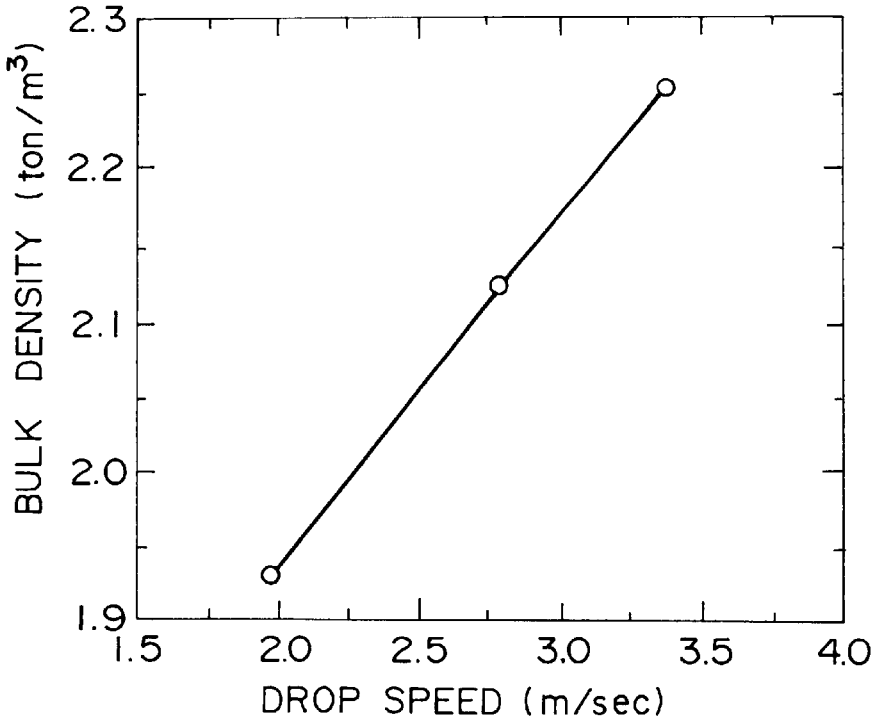
FIG. 22 graphically represents the relationship between the drop speed (m/sec) of a sintering material and the bulk density (ton/$m^3$) of a sintering material layer.
Figure 28:
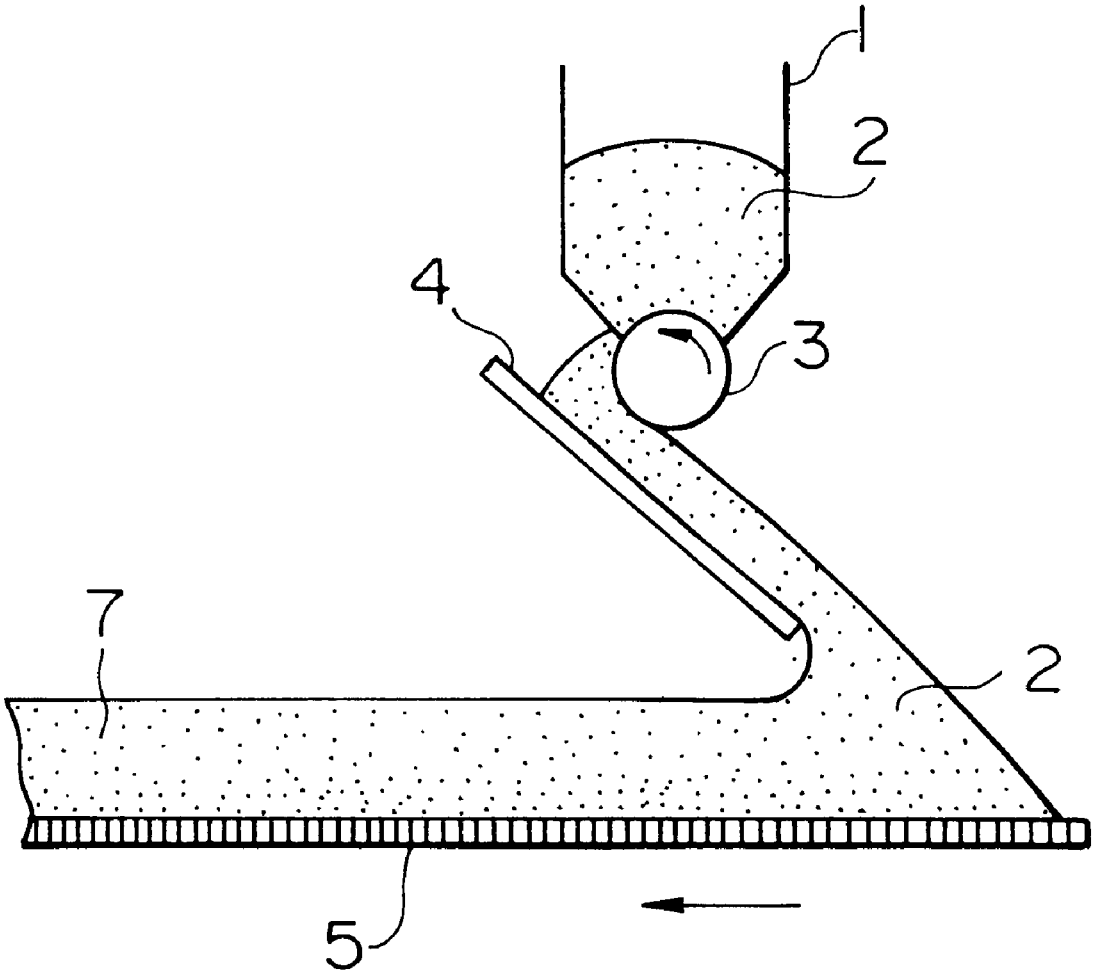
FIG. 28 is a vertically cross-sectional view showing a sintering material loading apparatus of the prior art.

The bulk density of the sintering material layer 7 deposited on the pallet 5 has a great effect on the productivity of a sintered ore. For example, the relationship between the bulk density of a sintering material and the productivity of a sintered ore has been confirmed, as shown in FIG. 21, from the experiments conducted with use of a DL sintering apparatus commercially available. The results reveal that reduced bulk density of a sintering material leads to improved productivity of a sintered ore. In the case of the sintering material apparatus of the prior art shown in FIG. 28 in which a sintering material 2 is charged directly on a pallet 5 from a lower end of a sloping chute 4 without magnetization, the bulk density of the sintering material layer 7 is about 1.9. If the sintering material 2 is charged on the pallet 5 with the bulk density of the sintering material layer 7 made smaller than above, the productivity of a sintered ore may possible be improved. Furthermore, the relationship between the speed of dropping on a pallet 5 and the bulk density of a sintering material 2 is shown in FIG. 22, As the drop speed of the sintering material 2 is lowered, the bulk density can be reduced.

Figure 23:
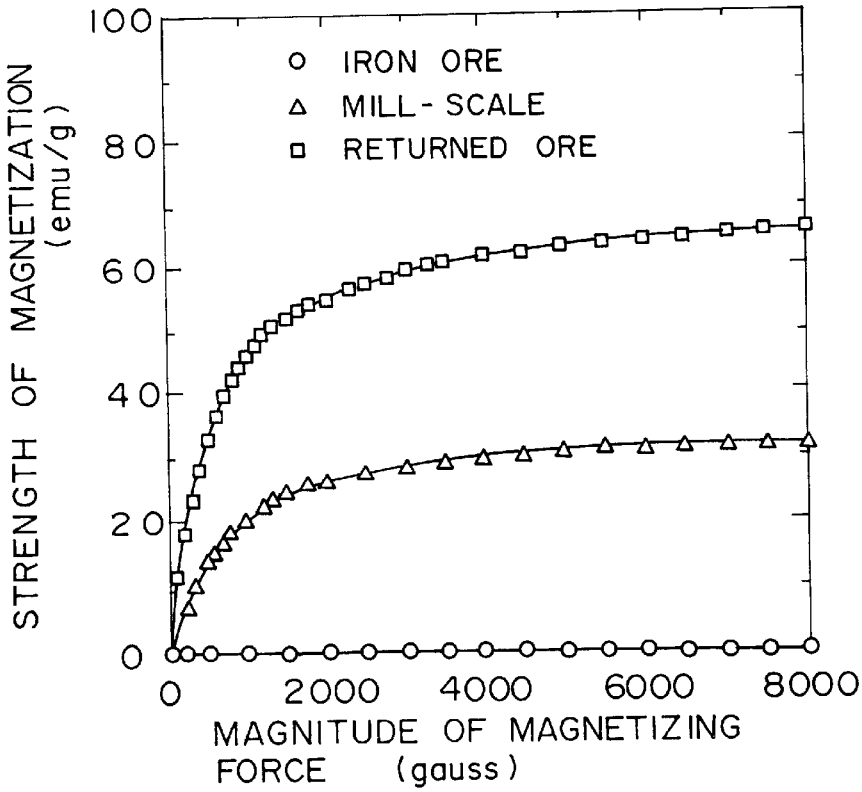
FIG. 23 graphically represents the relationship between the magnitude (Gauss) of magnetic force of a permanent magnet and the magnetization strength (emu/g) of a sintering material.

Exertion of magnetic forces from a plurality of permanent magnets 22 arrayed on a back side of the plate-type sloping chute 4 produces reduced drop speed of magnetically susceptible sinterable substances present in a sintering material. Magnetic characteristics of the sintering material were measured with an oscillating magnetometer. Based on the results, the relationship between the magnitude (Gauss) of a magnetic force and the strength (emu/g) of magnetization is shown in FIG. 23. Although iron ore as ferrous material present in the sintering material is nil in its magnetization magnitude as shown in FIG. 23, returned ore and mill scale formulated to be contained in an amount of 20–30% in the sintering material show a great magnetization magnitude and have proved to be a magnetically sinterable material of high susceptibility to a magnet.

Figure 24:
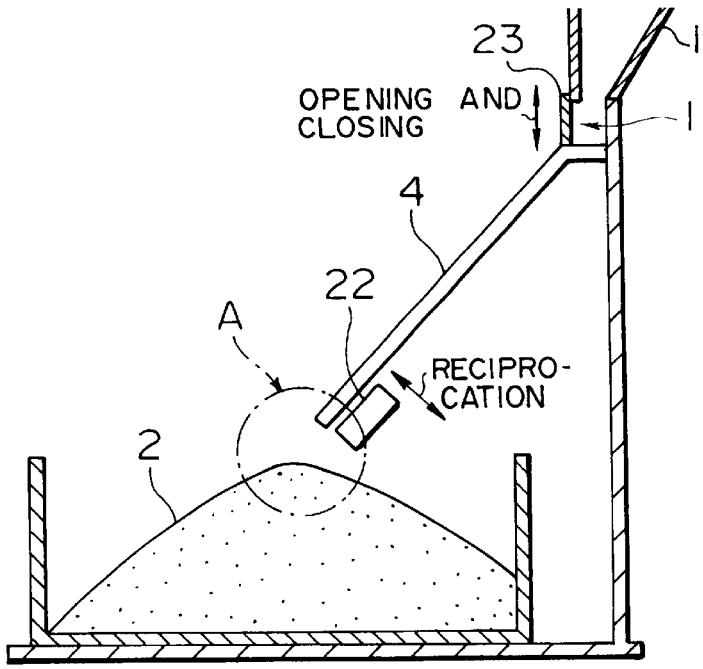
FIG. 24 is a view, as shown vertically cross-sectionally, of a laboratory loading apparatus made of vinyl chloride resin.

In Japanese Unexamined Patent Publication No. 58-133333 cited above, it is disclosed that when a sintering material is exposed to a magnetic force during charging on a pallet, the drop speed is reduced with possible mild loading. To confirm the reduction of drop speed by application of a magnetic force, loading experiments were performed with a laboratory loading apparatus made of polyvinyl chloride as illustrated in FIG. 24. The formulation of the sintering material used is shown in Table 3. As magnetically susceptible sinterable materials, returned ore was 15% and mill scale 4.25%. In these experiments, permanent magnets 22 were arranged vertically along a back side of a PVC sloping chute 4 and were moved perpendicular to a back surface of the chute such that the magnetic forces on a front surface of the chute were varied to be 0 Gauss, 500 Gauss and 900 Gauss, respectively. A sintering material was supplied, from an ore supplying hopper 1 by opening and closing a dumper 23, to the sloping chute 4. The manner in which the sintering material was being dropped out of a lower end of the sloping chute was recorded at a video recording point A with a high-speed video every other 1/1,000 second to thereby measure the drop speed of the sintering material.

Figure 25:
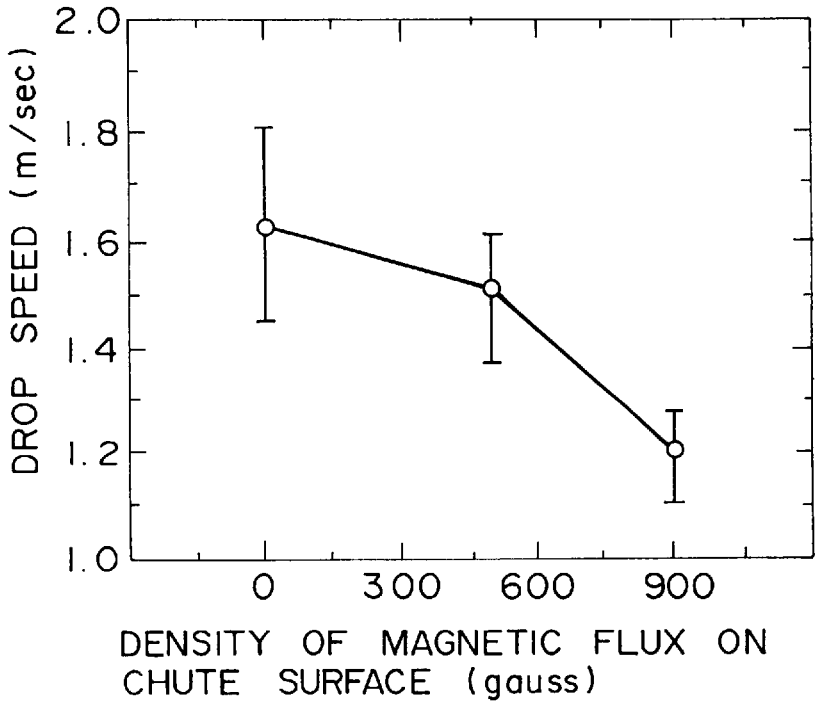
FIG. 25 graphically represents the relationship between the magnetic flux density (Gauss) on a chute surface and the drop speed (m/sec) of a sintering material in the case of use of a permanent magnet.
Figure 26A:
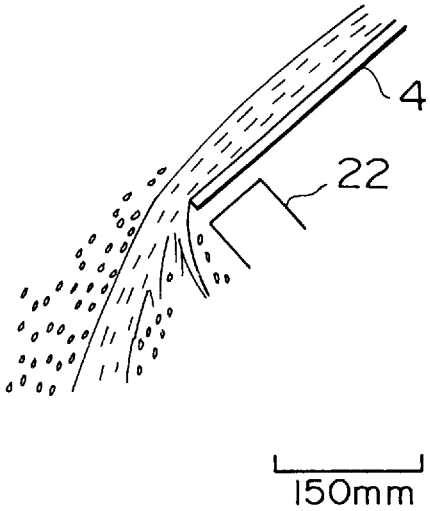
FIG. 26 is explanatory of the case (FIG. 26A) wherein a magnetic force of 900 Gauss was applied to a permanent magnet located backwardly downwardly of a sloping chute as compared to the case (FIG. 26B) wherein application of a magnetic force to that magnet was omitted.
Figure 26B:
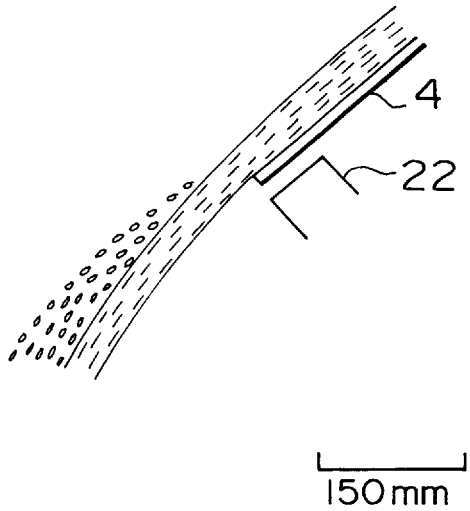

The relationship between the magnetic flux density (Gauss), namely the magnitude of a magnetic force on the front surface of the sloping chute, and the drop speed (m/sec) of the sintering material is shown in FIG. 25. As evidenced by this figure, it has been found that as the magnetic flux density is increased from 0 Gauss to 900 Gauss, the drop speed of the sintering material is decreased from 1.6 m/sec to 1.2 m/sec. Inspection of details of dropping from the lower end of the sloping chute 4 at that time showed that in a case with a magnetic force of 900 Gauss applied from the permanent magnets 22 (FIG. 26A), a dropping flow of sintering material was vertically wide as compared to a case with no magnetic force applied (FIG. 26B). This means that application of a magnetic force enables gentle loading of the sintering material.

Subsequently, the effects of a magnetic force on the productivity of a sintered ore were examined by use of a sintering material loading apparatus shown in FIG. 20. Four permanent magnets 22 were disposed vertically backwardly of a sloping chute made of stainless steel (SUS 304). With these permanent magnets displaced rearwardly remotely, experiments were conducted with no magnetic force applied to a front surface of the sloping chute (Experiment No. 1), with one and the same magnetic force applied (Experiment No. 2), and with varying magnetic forces applied to the respective permanent magnets (Experiment No. 3). The experiment levels are shown in Table 4.

Figure 27:
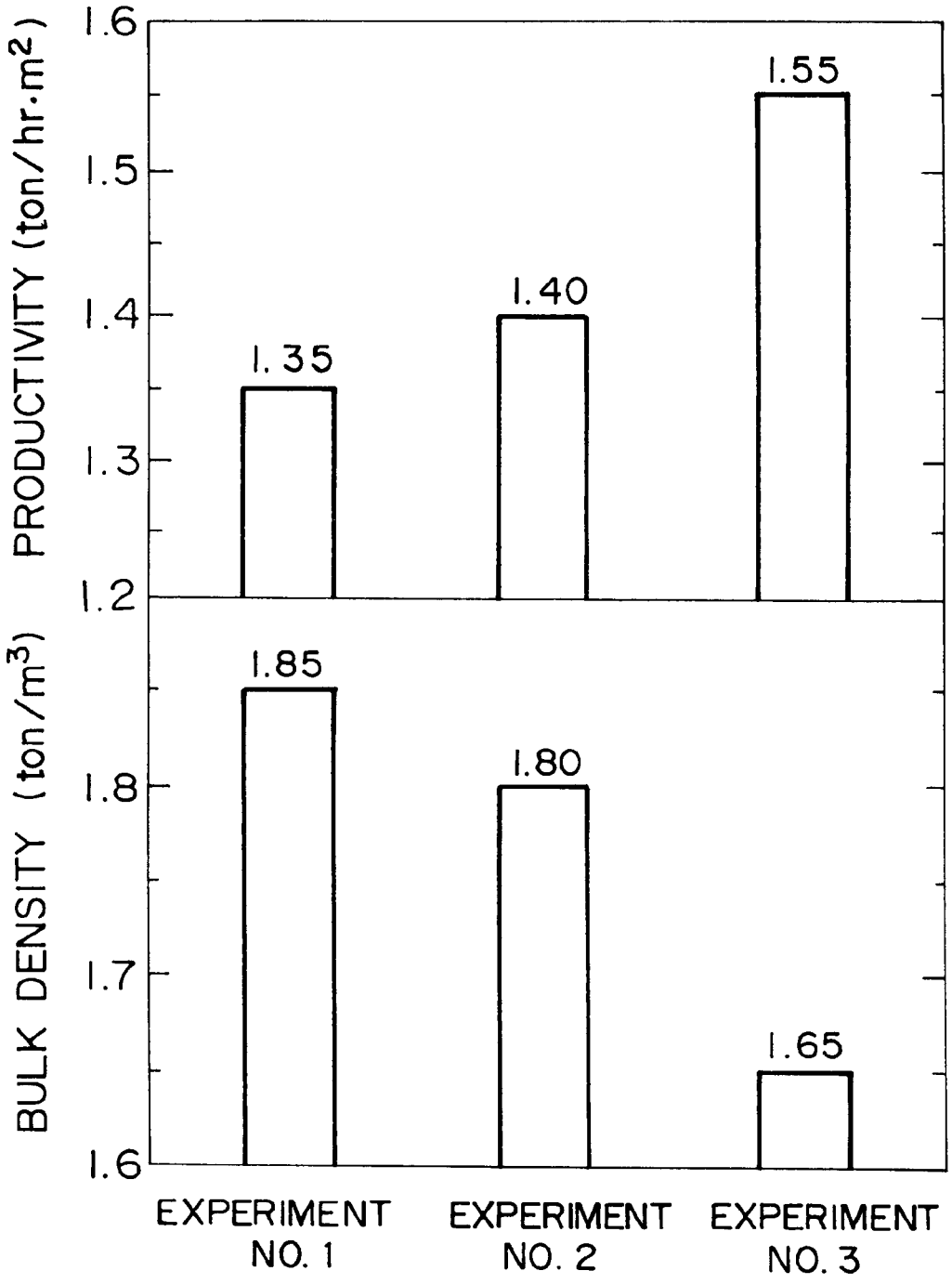
FIG. 27 represents, as bar graphs, the bulk density (ton/$m^3$) of a sintering material layer and the productivity (ton/hr.$m^2$) of a sintered ore in each of Experiment No. 1 in which no magnetic force was applied to four permanent magnets disposed backwardly of a sloping chute, Experiment No. 2 in which those magnets were magnetized at one and the same level, and Experiment No. 3 in which those magnets were magnetized with magnetic forces increased. progressively from top to bottom.

When magnetic forces beyond 700 Gauss were applied to the permanent magnets 22 disposed at an upper end of the sloping chute 4 with a low drop speed of the sintering material 2, magnetically susceptible sinterable material became still and flowless. Thus, the magnetic flux density on the upper portion of the sloping chute was set at 700 Gauss. In Experiment No. 2, the magnetic flux density was held constant at 700 Gauss at each position of each permanent magnet relative to the height of the sloping chute. In Experiment No. 3, the magnetic flux densities were increased from top to bottom at 900, 1100 and 1300 Gauss so as to match increased drop speeds. The results are shown in FIG. 27 in respect of the bulk density (ton/$m^3$) of the sintering material and the productivity (ton/hr.$m^2$) of the finished sintered ore.

Upon comparison of Experiment No. 1 with Experiment No. 2, it has been proved that application of magnetic forces to the sintering material reduces the magnetic flux density by 0.05 ton/$m^3$ as compared to an instance with no application of magnetic force. Further comparison of Experiment No. 2 to Experiment No. 3 reveals that when the magnetic flux density is set to be higher progressively downwardly of the sloping chute 4, the bulk density is reduced by 0.15 ton/$m^3$, and the productivity is improved by 0.15 ton/hr.$m^2$. With the sintering material loading apparatus FIG. 20 employed, magnetically susceptible sinterable material and fine material of low drop speed can be segregated in large amounts in an upper portion 7A of the sintering material layer 7 deposited on the pallet 5.

In the practice of the embodiments of the present invention as noted in connection with FIGS. 1 to 8 and FIGS. 9 to 19, a magnetic force is suitably applicable to a sintering material during charging on a pallet so that the bulk densities of sintering material layers can be reduced even though the results are more or less variable.

According to this invention, as stated above, a magnetic force is applied, from a magnetic drum having built therein a permanent magnet or an electromagnet, or from a rectangular permanent magnet, to a sintering material when the latter is charged on a pallet after cutting by means of a drum feeder out of an ore supplying hopper mounted on a DL sintering apparatus. Thus, magnetically susceptible sinterable substances such as highly magnetic mill scale, returned ore and the like present in the sintering material are magnetically attached to its lower layer portion, and fine substances of low drop speed present in the sintering material are segregated in such lower layer portion, whereas weakly magnetic, non-magnetic and coarse substances present in the sintering material are segregated in its upper and intermediate layer portions.

By subsequent inversion of the sintering material during charging of the same on the pallet, magnetically susceptible sinterable substances of high magnetization and good sinterability and low-drop speed fine substances can be segregated in large amounts in an upper portion of a sintering material layer deposited on the pallet, and weakly magnetic, non-magnetic and coarse substances of low sinterability can be segregated in intermediate and lower portions of that layer. Reduced bulk density of the sintering material layer is also attainable.

For those reasons, a sintered ore formed from sintering on the pallet can be improved in respect of its sintering strength in the upper layer portion, and when coupled with the intermediate and lower layer portions of originally high sintering strength, the finished sintered ore can be made strong in its entirety. Hence, this invention allows the productivity of and the yield of a sintered ore to be enhanced with use of a DL sintering apparatus and without the need for increased equipment remolding and for added secondary material and carbon source.

TABLE 1

| $SiO_2$ | $Al_2O_3$ | $Fe_2O_3$ | FeO | C |
|---|---|---|---|---|
| 3.5–6.0 | 0.5–2.5 | 60–75 | 2.0–10.0 | 2.5–4.0 |

TABLE 2

| Ore Powder | Screen-pass Ore | Mill Scale | Limestone | Silica | Extra Charge: Returned Ore | Extra Charge: Coke |
|---|---|---|---|---|---|---|
| 62.3% | 15.6% | 5.8% | 15.3% | 1.0% | 17.0% | 4.0% |

TABLE 3

| | |
|---|---|
| Iron Ore | 66.50% |
| Mill Scale | 4.25% |
| Limestone | 13.32% |
| Silica | 0.93% |
| Returned Ore | 15.00% |

TABLE 3-continued

| | |
|---|---|
| Total | 100.00% |
| Coke | 4.00% |
| Water content | 6.80% |

TABLE 4

| | Magnet Flux Density of Each Magnet on Chute Surface | | |
|---|---|---|---|
| | Experiment 1 | Experiment 2 | Experiment 3 |
| Magnet 1 | 0 Gauss | 700 Gauss | 700 Gauss |
| Magnet 2 | 0 Gauss | 700 Gauss | 900 Gauss |
| Magnet 3 | 0 Gauss | 700 Gauss | 1100 Gauss |
| Magnet 4 | 0 Gauss | 700 Gauss | 1300 Gauss |

What is claimed is:

1. A method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the starting sintering material into layered form on the pallet, the method comprising: applying a magnetic force to a path of dropping of said starting sintering material having been cut through the drum feeder and being continuously flowed as said starting sintering material is slidably dropped out of a discharge end of a sloping chute of a plate type onto the pallet, the magnetic force being generated by a cylindrical magnetic drum located at the discharge end of the sloping chute; causing magnetically susceptible sinterable substances present in said starting sintering material to be magnetically attracted toward the magnetic drum; and deviating the path of dropping of said starting sintering material and lowering a drop speed thereby the drop area on the pallet is enlarged so that said starting sintering material is softly loaded on the pallet, while in the process of slidably dropping on the sloping chute segregating particulate substances of low drop speed present in said starting sintering material in a lower portion, whereby both said magnetically susceptible sinterable substances and said particulate substances of low drop speed are segregated in large amounts in an upper portion of the sintering material layer on the pallet by inverting said starting sintering material when it is finally loaded on the pallet with use of the magnetic drum.

2. The method of the magnetic loading of a sintering material according to claim 1, wherein part of said starting sintering material having become adherent to the magnetic drum is removed by a scraper disposed in abutting relation to the magnetic drum and is then recovered on the pallet.

3. The method of the magnetic loading of a sintering material according to claim 2, wherein an ancillary sloping chute is located beneath the plate-type sloping chute normally disposed and in parallel spaced relation to the latter, the normal sloping chute being reciprocative between a position in which it is operative and an upwardly slant position in which it is retractive, the magnetic drum located downwardly of the normal sloping chute is horizontally reciprocative forward and backward, and the starting sintering material is adjusted such that the path of dropping from the ancillary sloping chute to the magnetic drum is prevented form becoming varied through horizontal recipocation of the magnetic drum located downwardly of and correspondingly to the ancillary sloping chute when the stating sintering material is charged by the downward ancillary sloping chute during displacement of the normal sloping chute form its operative position to its upward retractive position so as to remove part of the starting sintering material having attached thereto.

4. The method of the magnetic loading of a sintering material according to claim 2, wherein a permanent magnet is disposed downwardly of the plate-type sloping chute, and the speed at which said starting sintering material is dropped form the sloping chute to the magnetic drum is reduced by magnetization of, through the magnetic force of the permanent magnet, said starting sintering material while it is being dropped out of the sloping chute.

5. The method of the magnetic loading of a sintering material according to claim 2, wherein an auxiliary magnet drum is arranged upstream of and opposite to the magnetic drum located downwardly of the plate-type sloping chute, and magnetically susceptible sinterable substances present in said starting sintering material are magnetically attached to the auxiliary magnetic drum through its magnetizing action, which sinterable substance have failed to get magnetically attracted to the magnetic drum during dropping between the magnetic drum and the auxiliary magnetic drum.

6. The method of the magnetic loading of a sintering material according to claim 1, wherein an endless belt is arranged in interengagement with the magnetic drum located downwardly of the plate-type sloping chute and also with a drum placed opposite to the magnetic drum, and part of said starting sintering material having been adherent to the endless belt is removed by a scraper held in abutting relation to the endless belt and Is then recovered on the pallet.

7. The method of the magnetic loading of a sintering material according to claim 6, wherein an ancillary sloping chute is located beneath the plate-type sloping chute normally disposed and in parallel spaced relation to the latter, the normal sloping chute being reciprocative between a position in which it is operative and an upwardly slant position in which it is retractive, the magnetic drum located downwardly of the normal sloping chute is horizontally reciprocative forward and backward, and the starting sintering material is adjusted such that the path of dropping from the ancillary sloping chute to the magnetic drum is prevented form becoming varied through horizontal recipocation of the magnetic drum located downwardly of and correspondingly to the ancillary sloping chute when the stating sintering material is charged by the downward ancillary sloping chute during displacement of the normal sloping chute form its operative position to its upward retractive position so as to remove part of the starting sintering material having attached thereto.

8. The method of the magnetic loading of a sintering material according to claim 6, wherein a permanent magnet is disposed downwardly of the plate-type sloping chute, and the speed at which said starting sintering material is dropped form the sloping chute to the magnetic drum is reduced by magnetization of, through the magnetic force of the permanent magnet, said starting sintering material while it is being dropped out of the sloping chute.

9. The method of the magnetic loading of a sintering material according to claim 1, wherein an ancillary sloping chute is located beneath the plate-type sloping chute normally disposed and in parallel spaced relation to the latter, the normal sloping chute being reciprocative between a position in which it is operative and an upwardly slant position in which in which it is retractive, the magnetic drum located at the discharge end of the normal sloping chute is horizontally reciprocative forward and backward, and the starting sintering material is adjusted such that the path of dropping from the ancillary sloping chute to the magnetic drum is prevented from becoming varied by moving the magnetic drum to the discharge end of the ancillary sloping chute when the starting sintering material is charged by the ancillary sloping chute during displacement of the normal sloping chute during displacement of the normal sloping chute from its operative position so as to remove part of the starting sintering material having attached thereto.

10. The method of the magnetic loading of a sintering material according to claim 9, wherein a permanent magnet is disposed downwardly of the plate-type sloping chute, and the speed at which said starting sintering material is dropped form the sloping chute to the magnetic drum is reduced by magnetization of, through the magnetic force of the permanent magnet, said starting sintering material while it is being dropped out of the sloping chute.

11. The method of the magnetic loading of a sintering material according to claim 1, wherein a permanent magnet is disposed downwardly of the plate-type sloping chute, and the speed at which said starting sintering material is dropped from the sloping chute to the magnetic drum is reduced by magnetization of, through the magnetic force of the permanent magnet, said starting sintering material while it is being dropped out of the sloping chute.

12. The method of the magnetic loading of a sintering material according to claim 1, wherein an auxiliary magnet drum is arranged upstream of and opposite to the magnetic drum located downwardly of the plate-type sloping chute, and magnetically susceptible sinterable substances present in said starting sintering material are magnetically attached to the auxiliary magnetic drum through its magnetizing action, which sinterable substances have failed to get magnetically attracted to the magnetic drum during dropping between the magnetic drum and the auxiliary magnetic drum.

13. The method of the magnetic loading of a sintering material according to claim 1, wherein a first magnetic drum located downwardly of an upper sloping chute of a plate type and a second magnetic drum located downwardly of a lower magnetic drum of a plate type are serially arranged in a two-staged formation, and magnetically susceptible sinterable substances present in said starting sintering material having dropped out of the upper sloping chute are magnetically attached to the first magnetic drum by its magnetizing action, while magnetically susceptible sinterable substances having dropped out of the lower sloping chute are magnetically attached to the second magnetic drum through its magnetizing action.

14. The method of the magnetic loading of a sintering material according to claim 1, wherein the magnitude of magnetic force of the magnetic drum, or the number of revolution of the latter is adjusted depending on the target amount of the magnetically susceptible sinterable substances to be segregated in an upper portion of the sintering material layer loaded on the pallet.

15. A method of the magnetic loading of a sintering material wherein a starting sintering material is cut out of an ore supplying hopper by means of a drum feeder and is then charged onto a pallet mounted on a sintering apparatus of a Dwight-Lloyd type to thereby bring the starting sintering material into layered form on the pallet, the method comprising: applying a magnetic force to said starting sintering material cut by the drum feeder, the magnetic force being generated from a magnetic drum positioned at a discharge end of the drum feeder; causing magnetically susceptible sinterable substances included in said starting sintering material to be magnetically attracted toward the magnetic drum side; while segregating particulate substances of low drop speed present in said starting sintering material in that lower portion, whereby both said magnetically susceptible sinterable substances and said particulate substances of low drop speed are segregated in large amounts in an upper portion of the sintering material layer on the pallet by inverting said starting sintering material when it is finally loaded on the pallet with use of the magnetic drum.

16. A method of the magnetic loading of a sintering material wherein a starting sintering material is cut out of an ore supplying hopper by means of a drum feeder and is then charged onto a pallet mounted on a sintering apparatus of a Dwight-Lloyd type to hereby bring the starting sintering material into layered form on the pallet, the method comprising: applying a magnetic force to said starting sintering material having been cut through the drum feeder and being continuously flowed as said starting sintering material slidably dropped out of a tip of a sloping chute of a plate type onto the pallet, the magnetic force being generated by a cylindrical magnetic drum located downwardly of the sloping chute; an ancillary sloping chute is located beneath the plate-type sloping chute normally disposed and in parallel spaced relation to the latter, the normal sloping chute being reciprocative between a position in which it is operative and an upwardly slant position in which it is retractive, the magnetic drum located downwardly of the normal sloping chute is horizontally reciprocative forward and backward, and the starting sintering material is adjusted such that the path of dropping from the ancillary sloping chute to the magnetic drum is prevented from becoming varied through horizontal reciprocation of the magnetic drum located downwardly of and correspondingly to the ancillary sloping chute during displacement of the normal sloping chute from its operative position to its upward retractive position so as to remove part of the starting sintering material having attached thereto; and causing magnetically susceptible sinterable substances present in said starting sintering material to be magnetically attracted toward and attached to a lower portion of the sintering material layer, while segregating particulate substances of low drop speed present in said starting sintering material in that lower portion, whereby both said magnetically susceptible sinterable substances and said particulate substances of low drop speed are segregated in large amounts in an upper portion of the sintering material layer on the pallet by inverting said starting sintering material when it is loaded on the pallet with use of the magnetic drum.

* * * * *